US005293925A

United States Patent [19]

Kumashiro et al.

[11] Patent Number: 5,293,925

[45] Date of Patent: Mar. 15, 1994

[54] METHOD OF AND APPARATUS FOR WITHDRAWING STRAND IN HORIZONTAL CONTINUOUS CASTING INSTALLATION

[75] Inventors: Hatsuyoshi Kumashiro; Toshio Iida; Sadaaki Murakawa; Makoto Ueda, all of Kobe; Yoshikazu Nishi, Ikeda; Taizou Kiyosuke, Kobe; Hiroyuki Nakashima, Hikari; Yoji Ao, Kitakyushu; Hideo Kaneko, Kobe; Hiroshi Iwasaki; Kazuaki Sueoka, both of Hikari; Kenichi Murai, Akashi, all of Japan.

[73] Assignees: Kawasaki Jukogyo Kabushiki Kaisha, Hyogo; Nippon Steel Corporation, Tokyo, both of Japan

[21] Appl. No.: 811,964

[22] Filed: Dec. 23, 1991

[30] Foreign Application Priority Data

| | | | |
|---|---|---|---|
| Dec. 26, 1990 | [JP] | Japan | 2-404942[U] |
| Jan. 7, 1991 | [JP] | Japan | 3-11436 |
| Feb. 19, 1991 | [JP] | Japan | 3-47557 |
| Mar. 12, 1991 | [JP] | Japan | 3-73803 |
| Mar. 27, 1991 | [JP] | Japan | 3-89559 |

[51] Int. Cl.[5] ..... B22D 11/20

[52] U.S. Cl. ..... 164/454; 164/484; 164/413

[58] Field of Search ..... 164/454, 484, 413, 451, 164/452, 440

[56] References Cited

U.S. PATENT DOCUMENTS

| | | | |
|---|---|---|---|
| 3,726,333 | 4/1973 | Goodrich et al. | 165/454 |
| 4,556,099 | 12/1985 | Yamamoto et al. | 164/451 |
| 4,602,669 | 7/1986 | Haisig et al. | 164/454 |
| 4,703,792 | 11/1987 | Colombo et al. | 164/448 |
| 4,884,624 | 12/1989 | Pleschiutschnigg | 164/454 |
| 4,949,777 | 8/1990 | Itoyama et al. | 164/454 |

FOREIGN PATENT DOCUMENTS

| | | | |
|---|---|---|---|
| 0226154 | 10/1986 | Japan | 164/451 |
| 0904880 | 2/1982 | U.S.S.R. | 164/413 |

*Primary Examiner*—Paula A. Bradley
*Assistant Examiner*—Erik R. Puknys
*Attorney, Agent, or Firm*—Oliff & Berridge

[57] ABSTRACT

In a method and apparatus for withdrawing a strand in a horizontal continuous casting installation, the strand is withdrawn from a mold by a predetermined stroke and then retracted by a smaller stroke corresponding to shrinkage of the strand. This cycle of withdrawal and retraction is repeated intermittently. A strand withdrawing and retracting characteristic of a cycle is set in a control unit, and pinch rolls for withdrawing and retracting the strand are controlled based on the set characteristic. Actual withdrawing and retracting strokes of the strand are detected by a detecting device and the detected signal is compared with the set characteristic to produce an instruction signal which is fed back to the pinch rolls, so that the positional accuracy of the strand and the quality of the strand are improved.

18 Claims, 28 Drawing Sheets

METHOD OF AND APPARATUS FOR WITHDRAWING STRAND IN HORIZONTAL CONTINUOUS CASTING INSTALLATION

BACKGROUND OF THE INVENTION

This invention relates to a method of and apparatus for withdrawing a strand in a horizontal continuous casting installation in which a strand is intermittently withdrawn from a mold provided for a tundish by repeating a cycle of withdrawal of the strand over a predetermined stroke and retracting the strand over a small stroke.

The strand withdrawing device of the horizontal continuous casting installation is constructed to carry out cycles of intermittent withdrawal of the strand from a mold provided for a tundish during a predetermined number of strokes (10–20 mm, for example) and retraction of the strand over a small stroke (0.3–1.5 mm, for example).

Molten steel supplied from the tundish and cast in the mold starts solidification from its outer surface. Subsequently, when the solidified strand is withdrawn over a predetermined stroke, the molten steel is poured again into the mold, and the cast steel begins to solidify. The cast strand extending to the outside of the mold gradually cools and shrinks. For this reason, after the withdrawal, and after stopping the cast strand for a short waiting time the strand is retracted toward the mold over a distance or stroke at least equal to the amount of the shrinkage. The purpose of the retraction is to ensure positive connection between a newly solidified shell in the most upstream portion of the mold and a solidified shell contiguous thereto. Then, the cast strand is stopped for a very short interval, and then the withdrawal of the cast strand of the next cycle is started. By repeating such intermittent withdrawal and retraction at intervals of 0.5 second, for example, the strand is formed continuously.

The behavior of formation of solidified shell in the mold is disclosed in Japanese Laid-Open Patent Publication No. Hei-1-39,860 published in 1989. The small stroke of retracting the cast strand is very important for improving the quality of the strand. Where the retraction stroke is deficient, a cold shut cracks tend to be formed at the interface between solidified shells, whereas when the retraction stroke is too large an adverse phenomenon occurs in the steel structure during solidification, so that it becomes unable to obtain cast strands of a predetermined quality. Thus, the ability of the retracting device depends greatly upon the high degree of positional accuracy at the time of withdrawal and retraction of the cast strand.

The cast strand withdrawing device of the horizontal continuous casting installation disclosed in Japanese Laid-Open Patent Publication No. Sho-58-202,954 published in 1983 includes two sets of withdrawing devices each having a hydraulic type clamping mechanism for clamping the cast strand, and a withdrawal hydraulic cylinder for withdrawing the clamping mechanism. By alternately operating these withdrawing devices, the cast strand can be intermittingly withdrawn.

The cast strand withdrawing device of a horizontal continuous casting installation disclosed in Japanese Laid-Open Patent Publication No. Sho 54-24,224 published in 1979 comprises a reversible continuous rotating shaft system and a reversible intermittent rotating shaft system having a clutch, a reciprocating mechanism for converting a rotary motion into a reciprocating motion, a mechanism for forwardly rotating pinch rolls during a forward operation of the reciprocating mechanism, and a mechanism for rearwardly rotating the pinch rolls during a rearward operation of the reciprocating mechanism.

In the strand withdrawing device of Japanese Laid-Open Patent Publication No. Sho-58-202,954 referred to above, the strand is withdrawn by the hydraulic cylinder, so that there is an influence of the compressibility of the hydraulic fluid, and therefore the positional accuracy is small. Furthermore, the strand are alternately withdrawn with two sets of withdrawing devices, and the loads of the withdrawing devices are different when the withdrawing devices are changed, thus resulting in increase of the positional error.

In the strand withdrawing device disclosed in Japanese Laid-Open Patent Publication No. Sho-54-24,224 referred to above, the gear train of the intermittently reversed rotating shaft system has a large backlash, so that the positional accuracy of the strand is lowered greatly and therefore such device cannot be used practically. In addition, in this withdrawing device, the intermittently reversed rotating shaft system and the reversible continuously rotating shaft system protrude beyond the end surfaces of the pinch rolls, where a plurality of molds are mounted on the tundish. For this reason the spacing between the strands (spacing between the lines) becomes large, so that there is a problem in the installation space. Furthermore, the intermittently reversed rotating shaft system and the reversible continuously rotating shaft system include many parts (gears, shafts, clutches, sprocket wheels, chains, etc.) whereby the construction becomes complicated and bulky, and is expensive.

SUMMARY OF THE INVENTION

Accordingly, it is an object of this invention to provide a novel method of withdrawing a cast strand for a horizontal continuous casting installation, capable of increasing, to a maximum extent, the positional accuracy with a simple construction when withdrawing or retracting the strand, and, to provide a novel apparatus for withdrawing a cast strand for a horizontal continuous casting installation, capable of being manufacturing at low cost.

According to one aspect of this invention, there is provided a cast strand withdrawing method wherein the strand is intermittently withdrawn by repeating a cycle of withdrawing the strand from a mold connected to a tundish of the horizontal continuous casting installation over a predetermined stroke by using withdrawing means, and retracting the withdrawn strand over a relatively short stroke, said method comprising the steps of: presetting, in control means of the withdrawing means, one cycle of a strand withdrawing and retracting characteristic; controlling the withdrawing means by the control means, based on said strand withdrawing and retracting characteristic during each said cycle; determining an instruction signal based on a comparison of a detection signal generated by detection means which detects an amount of withdrawal and retraction, with the strand withdrawing and retracting characteristic; and feedback controlling the withdrawing means in response to the instruction signal.

According to another aspect of this invention, there is provided a cast strand withdrawing apparatus including withdrawing means having pinch rollers which intermittently withdraw a cast strand by repeating a cycle of withdrawing the cast strand over a predetermined stroke from a mold provided for a tundish of a horizontal continuous casting installation, and retracting the withdrawn strand over a small stroke, and a servomotor for driving the pinch rollers, said apparatus comprising: control means preset with a strand withdrawing and retracting characteristic of one cycle of the strand withdrawal; detecting means for detecting strand withdrawing and retracting quantities and for producing a detection signal; means for comparing the detection signal with the strand withdrawing and retracting characteristic and for producing an instruction signal; and means for sending said instruction signal to the servomotor.

With this construction the positional accuracy of the withdrawal and retraction of the cast strand can be increased to a maximum extent and the casting installation can be made small and not expensive.

DESCRIPTION OF THE PREFERRED EMBODIMENTS

Some preferred embodiments of this invention will now be described with reference to the accompanying drawings.

Figure 1:
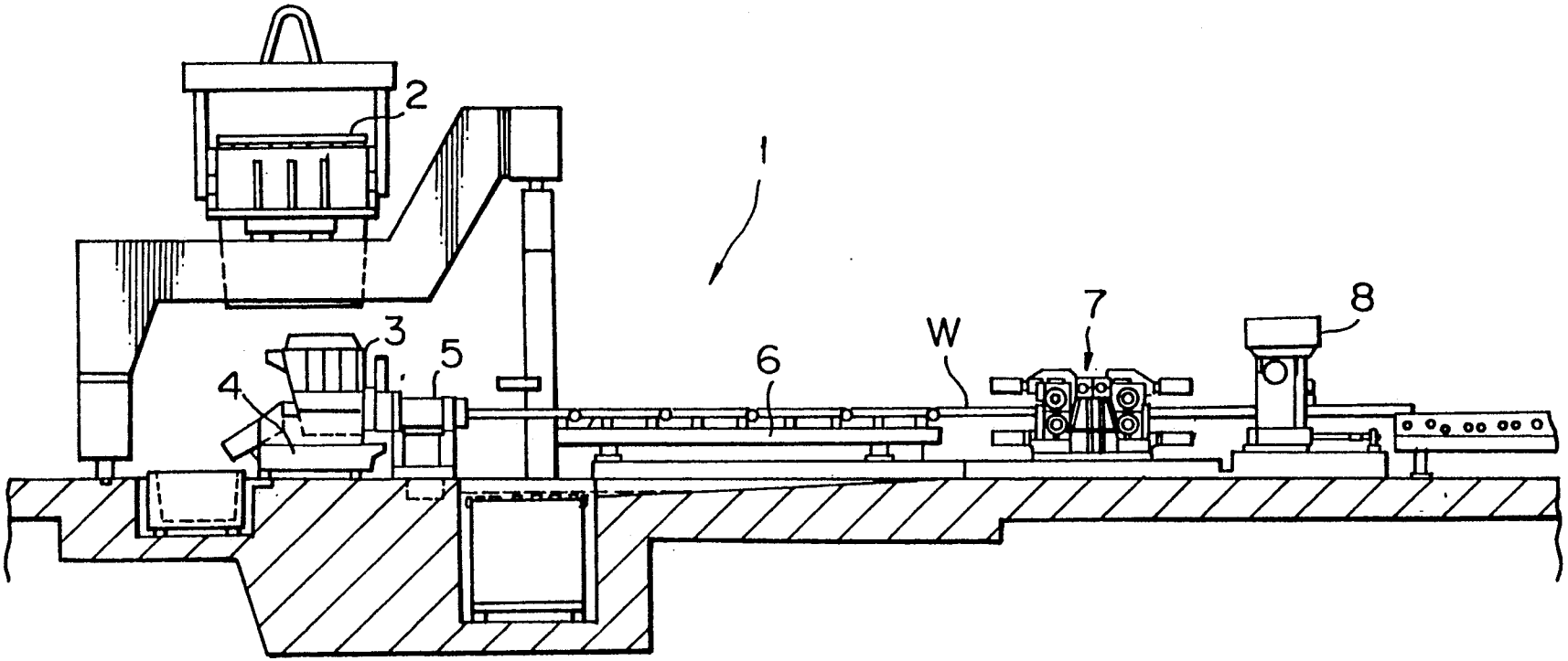
FIG. 1 is a front view showing a horizontal continuously casting installation to which the invention is applicable.

FIG. 1 shows a horizontal continuous casting installation 1. As is well known in the art, this casting installation 1 comprises a ladle 2, a tundish 3, a tundish car 4, and a horizontal mold 5 secured to the front surface of the tundish 3. A roller conveyor 6, a strand pulling out or withdrawing device 7 disposed at an intermediate point of the roller conveyor 6, a cutting device 8 installed at the downstream side of the device 7 are provided in line with the mold 5.

In this casting installation, molten steel is poured into the tundish 3 from the ladle 2, and the molten steel is then supplied into the mold 5 from the tundish 3. A strand W cast to have a desired cross-sectional configuration in the mold is sent to the downstream side by means of the roller conveyor 6. The strand W is intermittently pulled out or withdrawn by repeating a cycle including a withdrawal of a predetermined stroke and a retracting back over a small stroke, whereby a continuous casting of the strand W is carried out.

Figure 2:
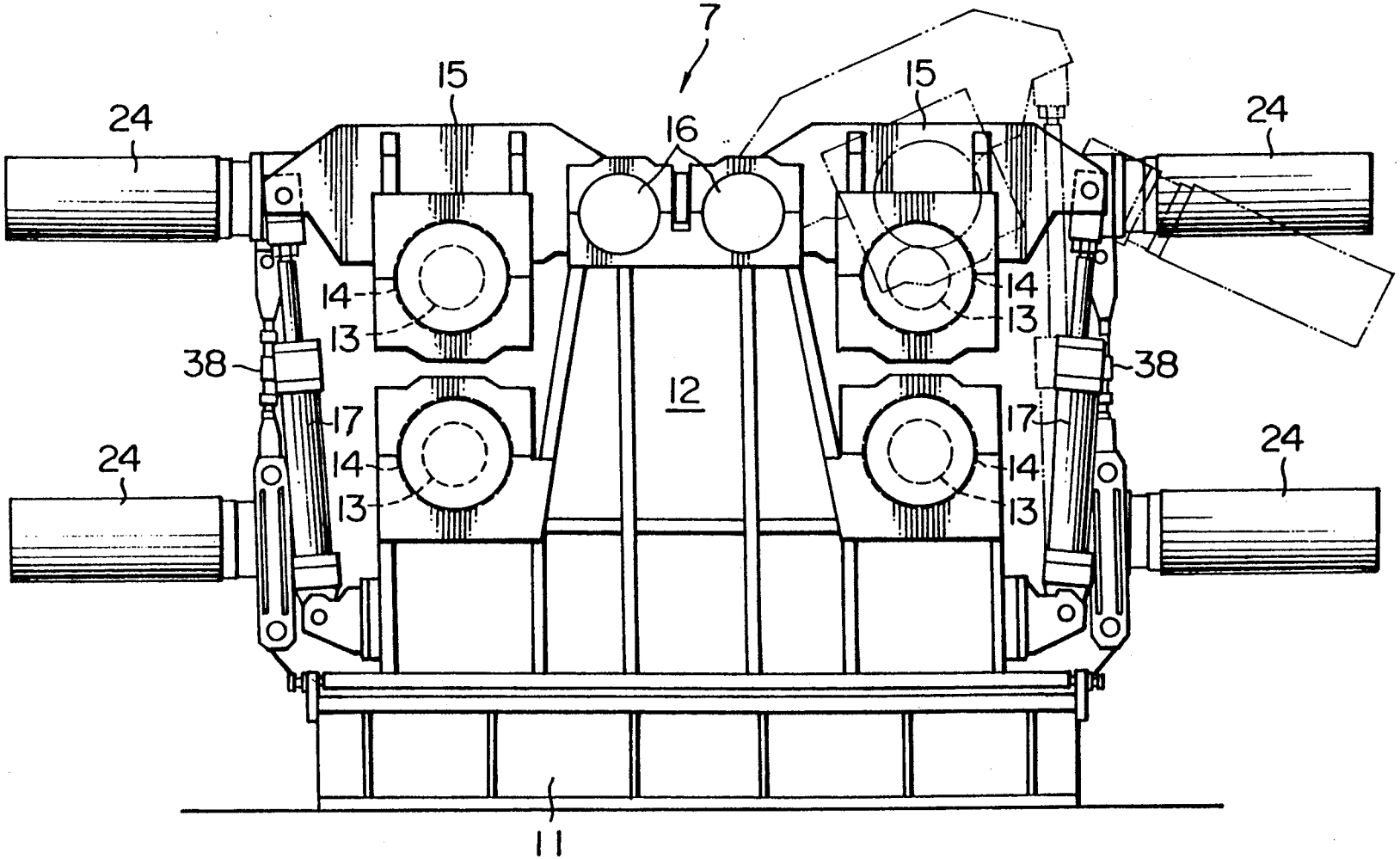
FIG. 2 is an enlarged front view showing a withdrawing device of the horizontal continuously casting installation shown in FIG. 1.
Figure 3:
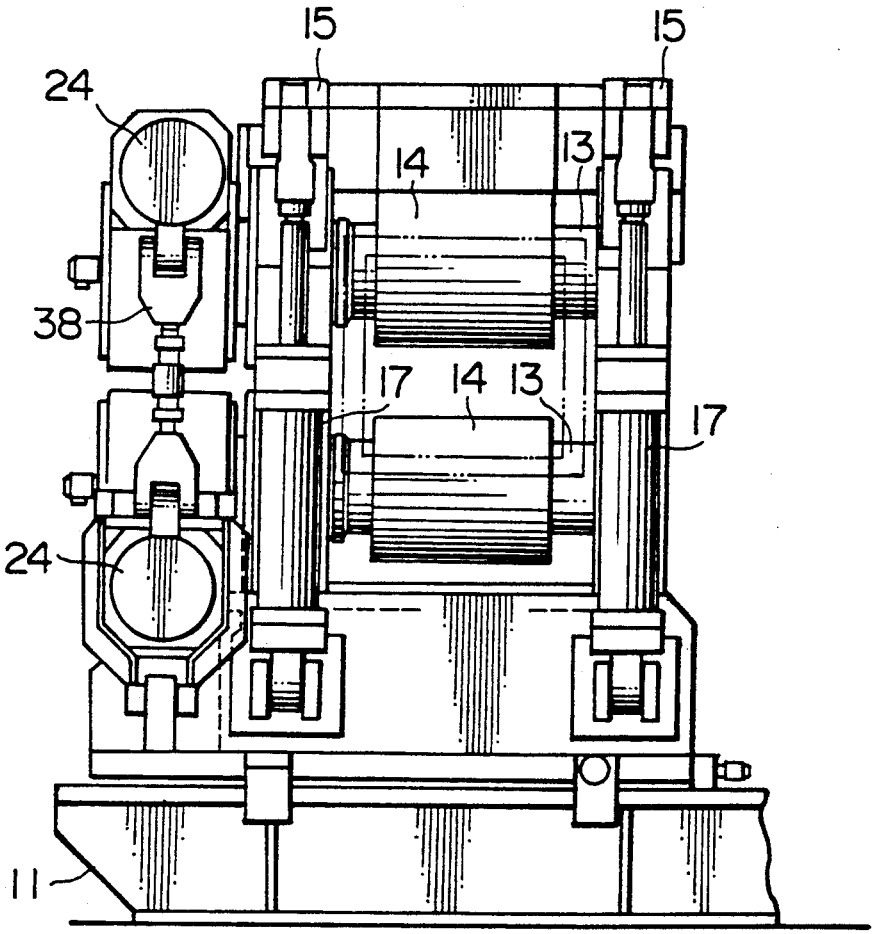
FIG. 3 is a side view of the withdrawing device of FIG. 2.

The withdrawing device 7 will be described below. As shown in FIG. 3, the withdrawing device 7 has a base 11 and at the central portion thereof, confronting or opposite supports 12 are erected to extend in the horizontal direction. The supports 12 are spaced apart in a direction transverse to the direction of feed of the strand W. On each of the upstream side (left side in FIG. 2) and the downstream side (right side) with regard to the direction of feed of the strand W are disposed a pair of vertically spaced roll shafts 13 and pinch rolls 14 respectively supported by the roll shafts 13. The lower roll shaft 13 on the upstream side is supported by bearings mounted on the base 11, and the lower roll shaft 13 on the downstream side is also supported by bearings mounted on the base 11.

Figure 5:
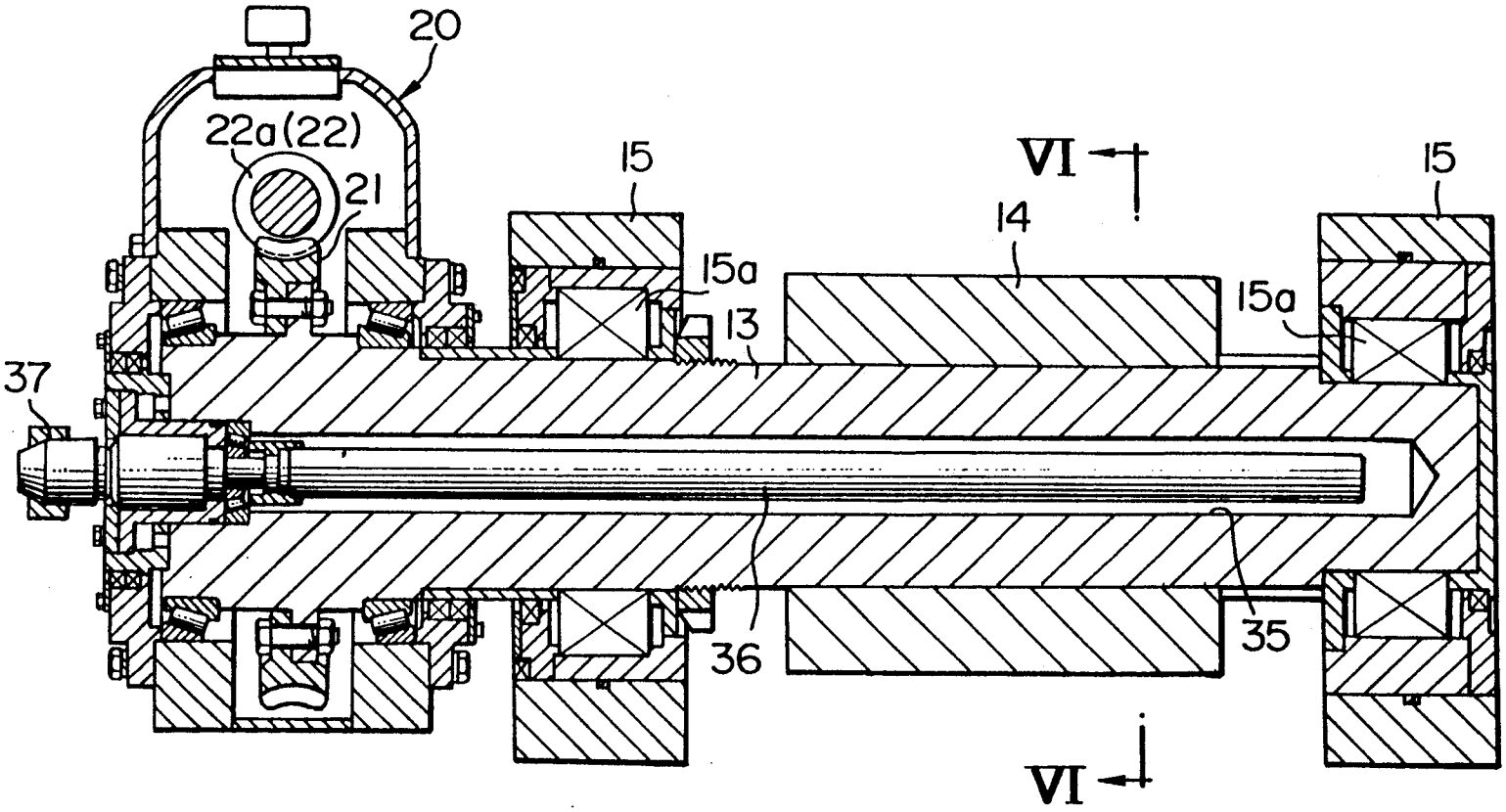
FIG. 5 is a sectional view taken along a line V—V in FIG. 4.

For the purpose of supporting the upper roll shaft 13 on the upstream side to be swingable in the vertical direction, a pair of arm members 15 are provided on the upstream side of the two supports 12 so as to confront each other in the transverse direction. As shown in FIG. 5, the upper roll shafts 13 on the upstream side are rotatably supported by a pair of the arm members 15 via bearings 15*a*, while as shown in FIG. 2 the proximal ends of the pair of the upstream arm members 15 are swingably supported on the upper end of the supports 12 via a common supporting shaft 16. A pair of hydraulic cylinders 17 are provided on both sides of the path of feed of the strand W for the purpose of tilting the pair of arm members 15 and urging the pinch rolls 14 toward the strand W, that is downwardly.

For the purpose of supporting the upper roll shafts 13 on the downstream side to be swingable in the vertical direction, another pair of interconnected arm members 15 are disposed on the downstream side of the supports 12, and the upper roll shafts 13 on the downstream side are rotatably supported by another pair of arm members 15 through bearings 16. The proximal ends of the pair of downstream arm members 15 are rotatably supported by the upper portions of the supports 12 via a common supporting shaft 16. Furthermore, a pair of hydraulic cylinders 17 are provided for the purpose of swinging the pair of arm members 15 or urging the pinch rolls 14 toward the strand W, that is downwardly.

Figure 6:
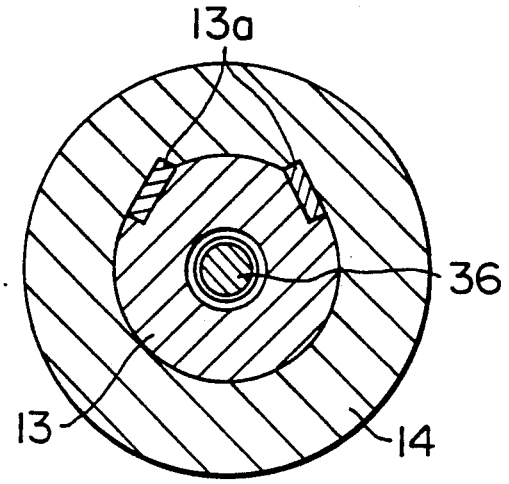
FIG. 6 is a sectional view taken along a line VI—VI in FIG. 5.

A driving device 20 for rotating the upper roll shaft 13 at the downstream side and the associated pinch roll 14 will be described with reference to FIG. 5. As shown, the pinch roll 14 surrounds the roll shaft 13 between two arm members 15, and as shown in FIG. 6, the pinch roll 14 is secured to the roll shaft 13 by means of tangential keys 13*a* so as not to rotate relatively.

Figure 4:
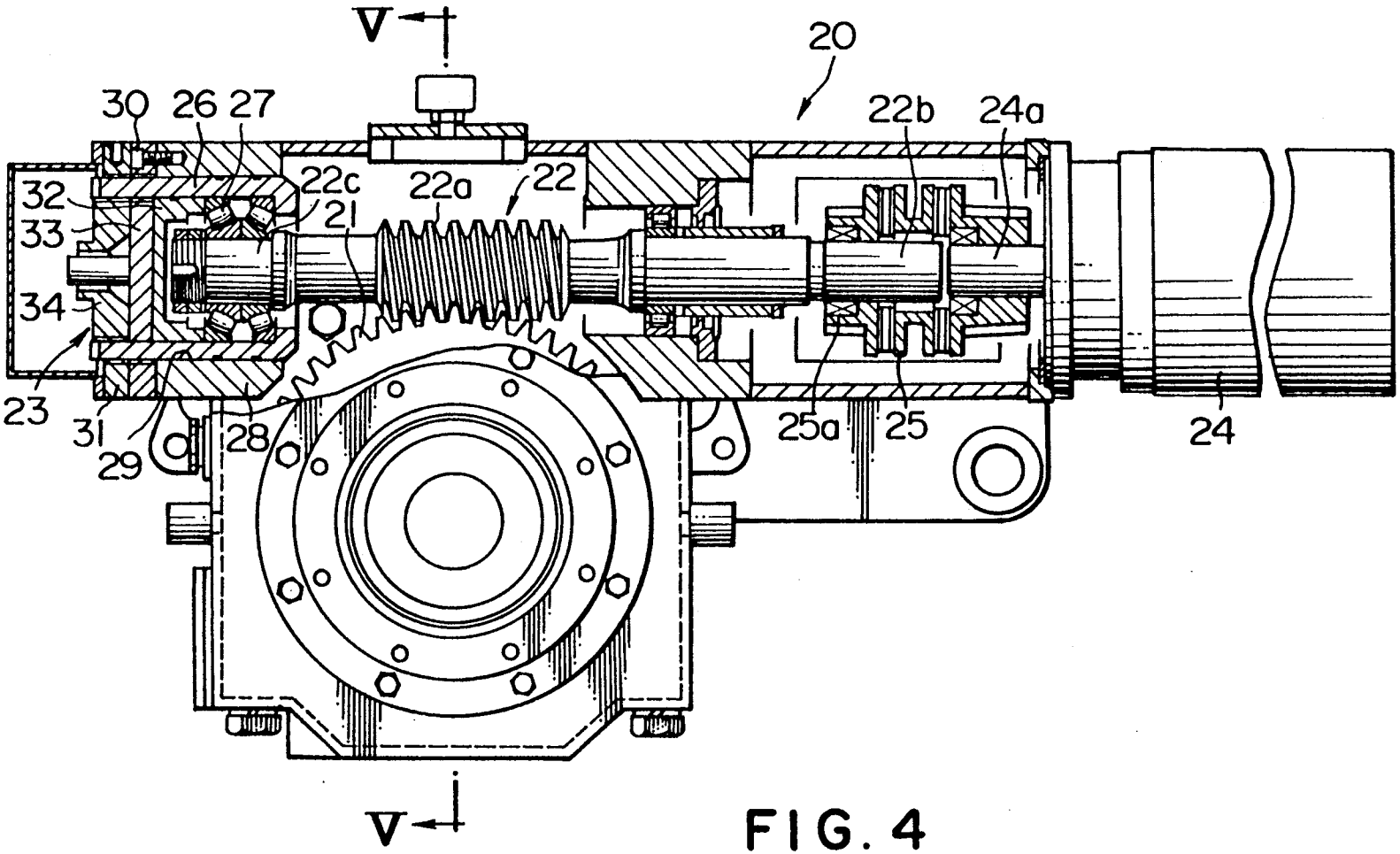
FIG. 4 is a front view, partly in section, showing a portion of a rotary driving device of the withdrawing device.

A worm wheel 21 is secured to the lefthand end, as viewed in FIG. 5, of the roll shaft 13, and a worm gear shaft 22 having a worm of a double lead type and meshing with the worm wheel 21 is horizontally arranged above the worm wheel, so as to extend in the direction of feed of the strand W. As shown in FIG. 4, an input shaft portion 22*b* is provided on the downstream side of the worm gear shaft 22. Thus a worm speed reduction mechanism including the worm wheel 21, worm gear shaft 22*a* and a position adjusting mechanism 23 is formed.

An AC servomotor 24 of the brushless motor type is coupled to each worm gear shaft 22 on the downstream side thereof. The output shaft 24*a* of the servomotor 24 is coupled to the input shaft portion 22*b* of the worm gear shaft 22 through a backlashless shaft coupling 25.

Figure 7:
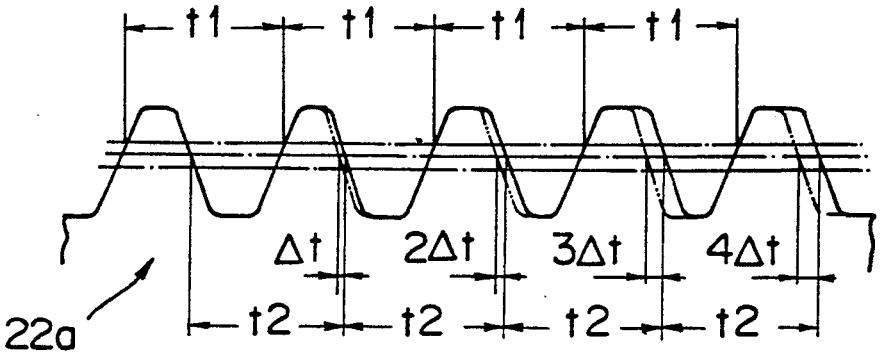
FIG. 7 is a diagrammatic representation of a double lead type worm gear means.
Figure 8:
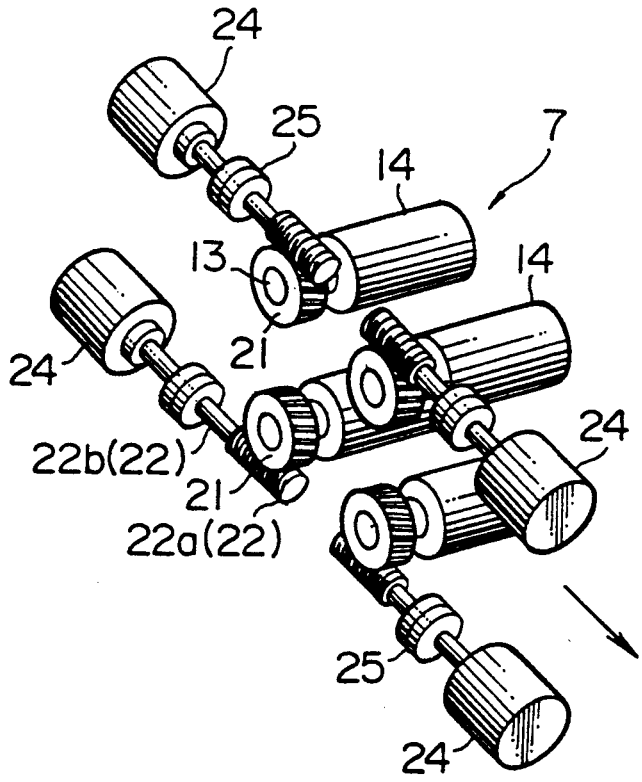
FIG. 8 is a diagrammatic perspective view showing the withdrawing device.

As shown in FIG. 7, the worm gear shaft 22*a* is provided with double lead type gear teeth for the purpose of preventing a backlash between the worm gear portion 22*a* and the worm wheel 21 of the worm speed reduction mechanism. The lead (pitch) on the downstream side flanks of the gear teeth is $t_1$, while the lead (pitch) on the upstream side flanks is $t_2$ which is larger than the lead $t_1$ by a small quantity $\Delta t$. In other words, the width of the gear is increased toward the downstream side. As a consequence, by adjusting the axial position of the worm gear shaft 22 by means of the position adjusting mechanism 23 (FIG. 4), a worm speed reduction mechanism having substantially zero backlash can be realized.

Regarding the position adjusting mechanism 23, an end portion 22*c* of the worm gear shaft 22 is supported by a bearing 27 in a cap-shaped bearing housing 26 that is axially slidably fitted in a hole 29. The bearing housing 26 is in screw engagement with a stationary nut 30 and a movable nut 31 which are internally threaded. The stationary nut 30 is secured to the housing 28 by means of a plurality of bolts. A retaining member 32 for retaining an end portion of the outer race of the bearing 27 is stopped by a locking member 33 which is in screw-engagement with the bearing housing 26. The locking member 33 is in screw-engagement with the bearing housing 26. The locking member 33 is prevented from being unscrewed by means of a set screw 34.

After loosening the locking mechanism 25*a* for securing the shaft coupling 25 to the input shaft portion 22*b* and after loosening the movable nut 31 and rotating the bearing housing 26, it is possible to finely adjust the axial position of the bearing housing 26, that is, the axial position of the worm gear shaft 22 with respect to the housing 28, toward the downstream or upstream side, so as to obtain a backlashless state. Thereafter when the set screw 34 and the movable nut 31 are tightened and the locking mechanism 25*a* is clamped, the backlashless state can be fixed. As shown in FIG. 5, for the purpose of cooling the roll shafts 13 and pinch rolls 14, an axial bore 35 is formed in the central portion of the roll shaft 13 and a pipe 36 is inserted in the axial bore 35 for supplying cooling medium into the axial bore 35 through a rotary coupling 37 and the pipe 36.

While in the foregoing, the driving device 20 for rotating the upper pinch roll 14 at the downstream side has been described, it will be understood that similar members are provided for the roll shaft of the upper pinch roll at the upstream side in a symmetrical relation with respect to the direction of feed. For the roll shaft 13 of the lower pinch roll 14 at the downstream side, similar members are also provided in substantially symmetric relation with the driving device 20. In other words, the roll shaft 13 of the lower pinch roll 14 at the upstream side is provided with members similar to the driving device of the lower pinch roll at the downstream side in a symmetric relation with respect to the direction of feed.

Figure 9:
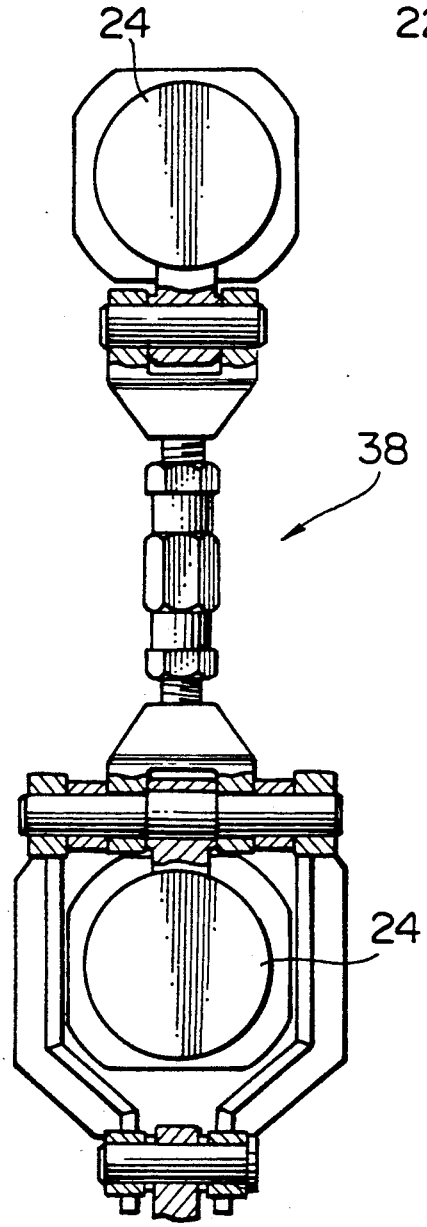
FIG. 9 is a side view showing a rotation restriction mechanism.

With regard to the four AC servomotors for driving the four driving devices 20, for restricting the rotation of each motor housing, the motor housings of the upper and lower two corresponding AC servomotors are connected to the base 11 by way of a rotation arresting mechanism 38 as shown in FIG. 9.

The control system of the withdrawing device 7 will now be described with reference to FIGS. 10 through 12.

Figure 10:
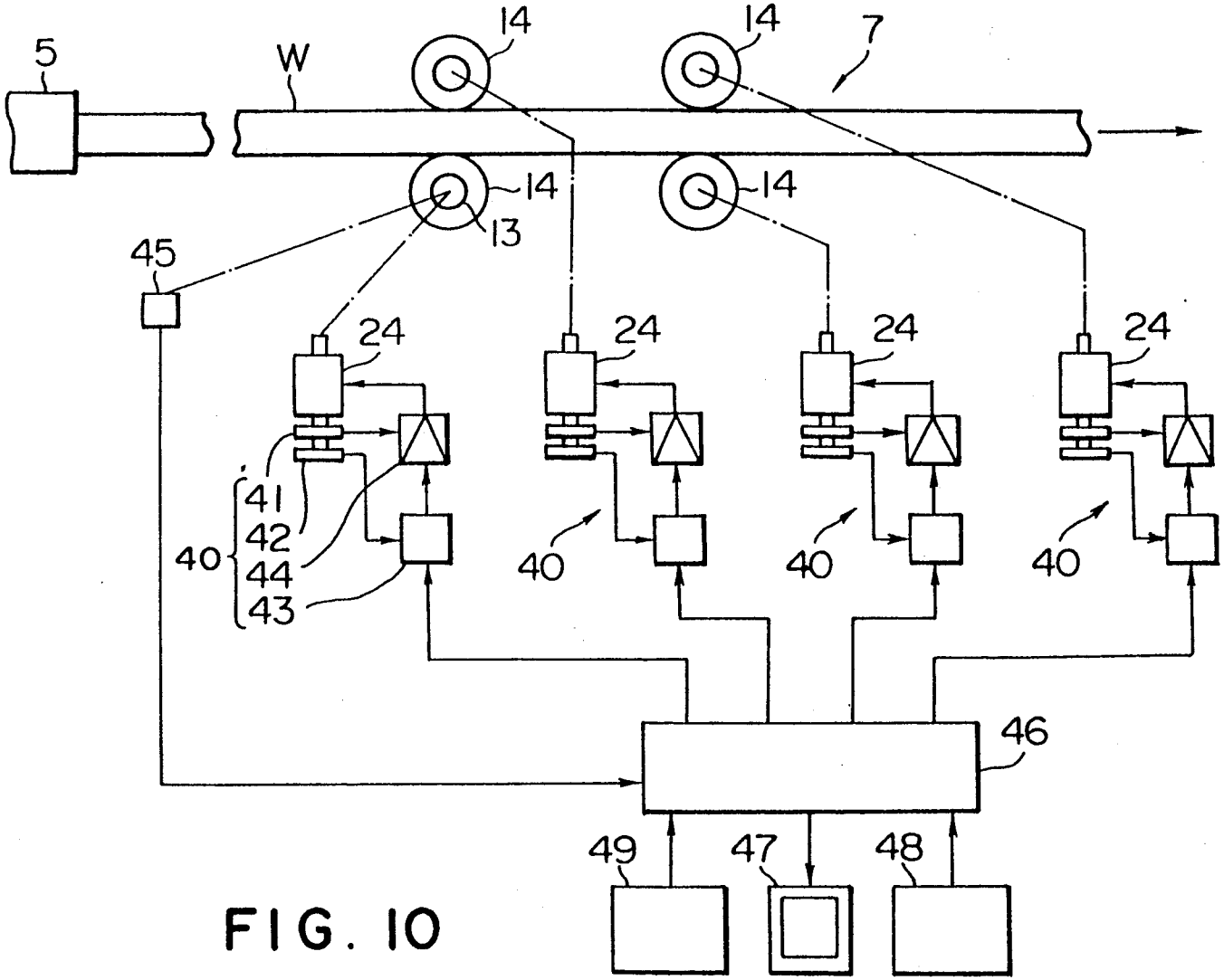
FIG. 10 is a block diagram showing a control system for the withdrawing device.

More particularly, as shown in FIG. 10, a servo control system 40 is provided corresponding to each AC servomotor 24. The servo control system 40 comprises a tachometer generator 41 for detecting the rotational speed of the servomotor 24, a pulse encoder 42 for detecting the rotational angle of the servomotor, a D/A converter 43 including a deviation counter (not shown), and a servo-amplifier 44. The rotational angle detection signal of the pulse encoder 42 of the servo control system for the servomotor 24 of the lower pinch roll 14 at the upstream side is applied to the D/A converter 43, while an instruction pulse is supplied to each D/A converter from a control unit 46. Respective D/A converters 43 apply control signals to the associated servo-amplifiers 44, while speed detection signals are supplied to servo-amplifiers 44 from respective tachometer generators 41.

Furthermore, a strand encoder 45 for detecting the rotational angle of the roll shaft 13 of the lower pinch roll 14 at the upstream side is provided at one end of the roll shaft 13 for supplying a signal from the strand encoder 45 to the control unit 46.

The control unit 46 comprises a microcomputer including a CPU, a ROM and a RAM, an input/output interface, a display controller for controlling a CRT display device 47, and a printer controller for controlling a printer 48. An operating panel 49 is connected to the control unit 46. The ROM of the microcomputer prestores a control program for strand withdrawal which controls four AC servomotors 24 in accordance with a withdrawing and retracting characteristic preset for individual type of the strand W.

As above described, the strand W is pulled out or withdrawn by repeating a withdrawal over a predetermined stroke and a subsequent small retracting stroke. In this case, the stroke characteristic and the speed characteristic for each cycle are set as shown in FIGS. 11 and 12. More particularly, the strand W is pulled out or withdrawn for about 0.2 second between times $t_0$ and $t_1$. Then the withdrawal is stopped for about 0.1 second between times $t_1$ and $t_2$. Thereafter, the strand W is retracted for about 0.1 second between times $t_2$ and $t_3$. Finally the retraction is stopped for about 0.1 second between times $t_3$ and $t_4$. The withdrawal stroke between times $t_0$ and $t_1$ is about 10 to 20 mm, while the small retraction stroke between times $t_2$ and $t_3$ is about 0.3 to 1.5 mm.

Figure 11:
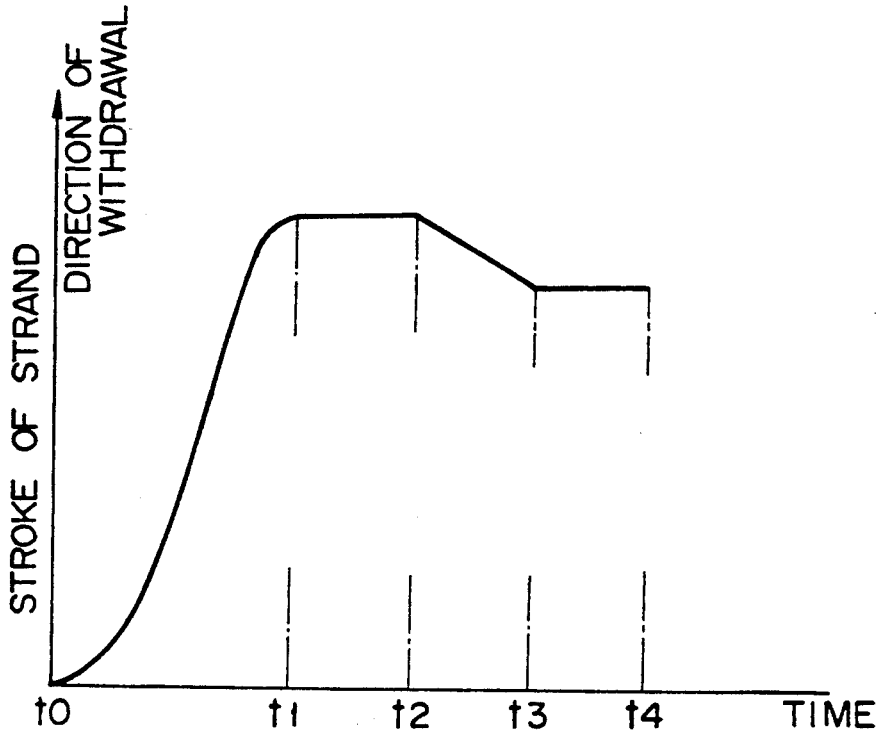
FIG. 11 is a graph showing a stroke characteristic of the strand per one cycle.
Figure 13:
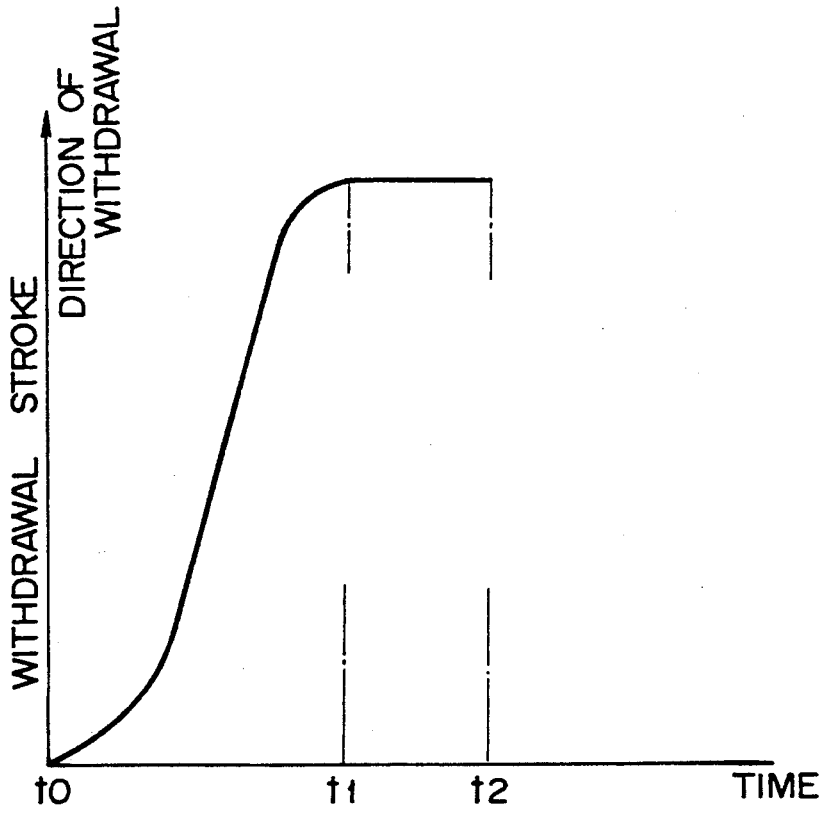
FIG. 13 is a graph showing a strand withdrawing stroke characteristic in one cycle.
Figure 14:
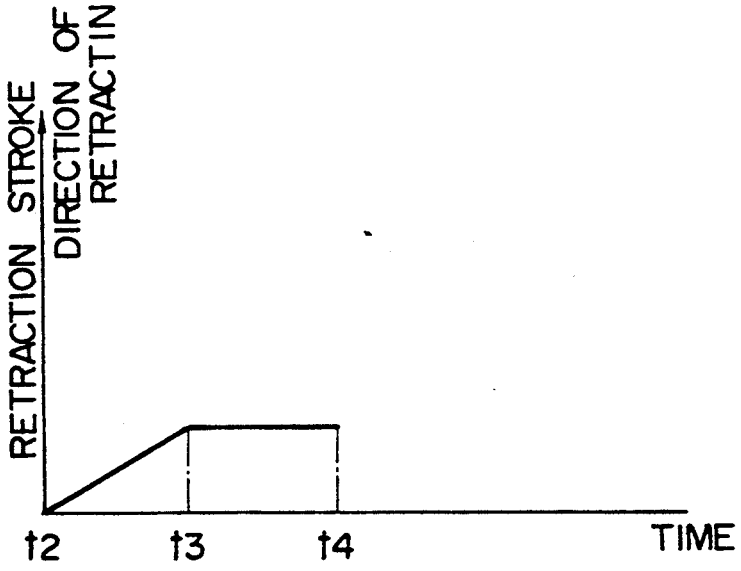
FIG. 14 is a graph showing a strand retracting stroke characteristic in one cycle.

The withdrawing characteristic shown in FIG. 13 corresponds to a portion of the characteristic shown in FIG. 11. The retracting characteristic shown in FIG. 14 corresponds to a portion of the characteristic shown in FIG. 11. The strand withdrawing characteristic shown in FIGS. 13 and 14 are prestored in the ROM in accordance with control programs for controlling the strand withdrawal.

The strand feed control will now be described.

In the case of the withdrawal, a pulse frequency acting as a speed instruction and a number of pulses acting as a positioning instruction are calculated and determined by the control unit 46 for each small interval of time. As a result of the calculation, an instruction pulse signal corresponding to the frequency and number of the pulse is applied to respective D/A converters 43 of the four servo control systems. In each D/A converter 43, by the action of the deviation counter contained therein, the deviation between the number of pulses of the instruction pulse signal and the number of pulses outputted from the pulse encoder 42 is given, and a speed instruction acting as a control signal having a voltage corresponding to the deviation is sent to the servo-amplifier 44. The position of the strand W is thus controlled by this feedback control. The servo-amplifier 44 determines the deviation voltage between the control signal received from the D/A converter 43 and the output of the tachometer generator 41 so as to supply to the AC servomotor 24 a three phase alternating current having a voltage proportional to the deviation voltage set forth above. Thus, the withdrawal is controlled by this feedback control.

In the case of the retraction of the strand, the speed characteristic is rectangular and of a low speed drive and so that the accuracy of the stroke control has a great influence on the quality of the cast strand W. For this reason, the rotational angle of the roll shaft 13 is directly detected by the strand encoder 45, for feeding back an actual stroke determined by the detection signal of the strand encoder 45 to a stroke determined by the retraction stroke characteristic indicated in FIG. 14. As a consequence, an instruction pulse signal similar to that described above is determined for each short time. This instruction pulse signal is supplied to the D/A converters 43 of the four servo control systems 40. As described above, the feedback control of the stroke and the feedback control of the speed are carried out in the same manner as described above.

As above described, since the instruction pulse signal is determined on the basis of the stroke characteristic shown in FIG. 14 and the detection signal of the strand encoder 45, it is possible to eliminate the influence of such errors as a delay in the electric response of the servo control system 40 or the motor 24 or a delay in the mechanical response. As a consequence, the retracting stroke can be controlled with high accuracy.

At the time of withdrawal, its stroke is large and high accuracy is not required as in the case of retraction. Accordingly, during the withdrawal, a standard deviation of the stroke control is calculated at each predetermined number of sampling or at each predetermined number of intervals in accordance with the detection signal of the encoder 42 corresponding to the lower roll shaft 13 at the upstream side, and the withdrawing stroke characteristic indicated in FIG. 13 is corrected sequentially by using the calculated standard deviation. However, also in the case of the withdrawal, the instruction pulse signal may be determined by using the detection signal of the strand encoder 45 as in the case of the retraction stroke.

The withdrawing device 7 operates as follows.

Since the worm wheel 21 is secured to one end of the roll shaft 13 of the pinch roll 14, there is no error producing factor other than the elastic torsional deformation, between the worm wheel 21 and the pinch roll 14. Furthermore, the worm speed reduction mechanism comprises the worm wheel 21 and the double lead type worm gear 22*a* and can be adjusted without any backlash so that the worm speed reduction mechanism can be used after adjusting it to have no backlash. Moreover, as the AC servomotor 24 is arranged coaxially with the worm gear shaft 22 and as the output shaft 24*a* of the motor 24 and the input shaft portion 22*b* of the worm gear shaft 22 are interconnected through the coupling 25 of the backlashless type, there is no error producing factor between the output shaft 24*a* of the motor 24 and the worm speed reduction mechanism.

As above described, the mechanism is constructed to have a least number of rotary motion transmitting parts between the output shaft 24*a* of the motor 24 to the roll shaft 13 and to substantially eliminate the backlash and the elastic torsional deformation of the shaft members, so that the positional accuracy at the time of withdrawal and retraction of the strand W can be greatly increased.

Since the rotary driving device 20 can be constructed with a small number of parts such as the motor 24, shaft coupling 25, worm speed reduction mechanism, etc., the construction can be greatly simplified and miniaturized.

The motor 24, worm gear shaft 22 and shaft coupling 25 are disposed in substantially the same plane as the worm wheel 21 at the end of the roll shaft 13 whereby the driving device 20 does not project beyond the side surface of the pinch rolls 14. For this reason, the overall width becomes small, thus decreasing the installation space. Where a plurality of molds are provided for the tundish 3, it is possible to make small the spacing between adjacent strands.

In addition, since the two pairs of upper and lower pinch rolls 14 are juxtaposed in the direction of withdrawal of the strand W, and since the driving devices are provided for the respective pinch rolls, the withdrawing force acting on the strand can be increased.

As above described, the four sets of motors 24 are feedback controlled by the servo control systems 40 such that the rotational speed and the rotational angle will have values instructed by the instruction pulse signal. At this time, for the purpose of correcting errors generated by a delay of the electric response of the servo control system 40, by a delay of the mechanical response of the driving device 20 and by thermal contraction of the strand W, the rotational angle of a pinch roll closest to the mold 5, among the lower pinch rolls, is detected by the strand encoder 45. In the case of retraction, an instruction pulse signal is determined, based on a preset strand feed characteristic, and a detection signal of the encoder 45. As a consequence, an instruction pulse signal corrected with respect to the various errors described above is determined so that the positional accuracy of the strand W at the time of retraction can be increased greatly.

At the time of retracting the strand W, its positional accuracy has a great influence upon the quality of the solidified shell formed in the mold. In the control system described above, the strand encoder 45 is provided for detecting the rotational angle of the pinch roll 14 closest to the mold 5, which is the lower pinch roll having the least error factor, whereby it becomes possible to detect the rotational angle representing the amount of movement of the strand W at a position closest to the mold 5, so that the positional accuracy of the strand W is increased.

Figure 15:
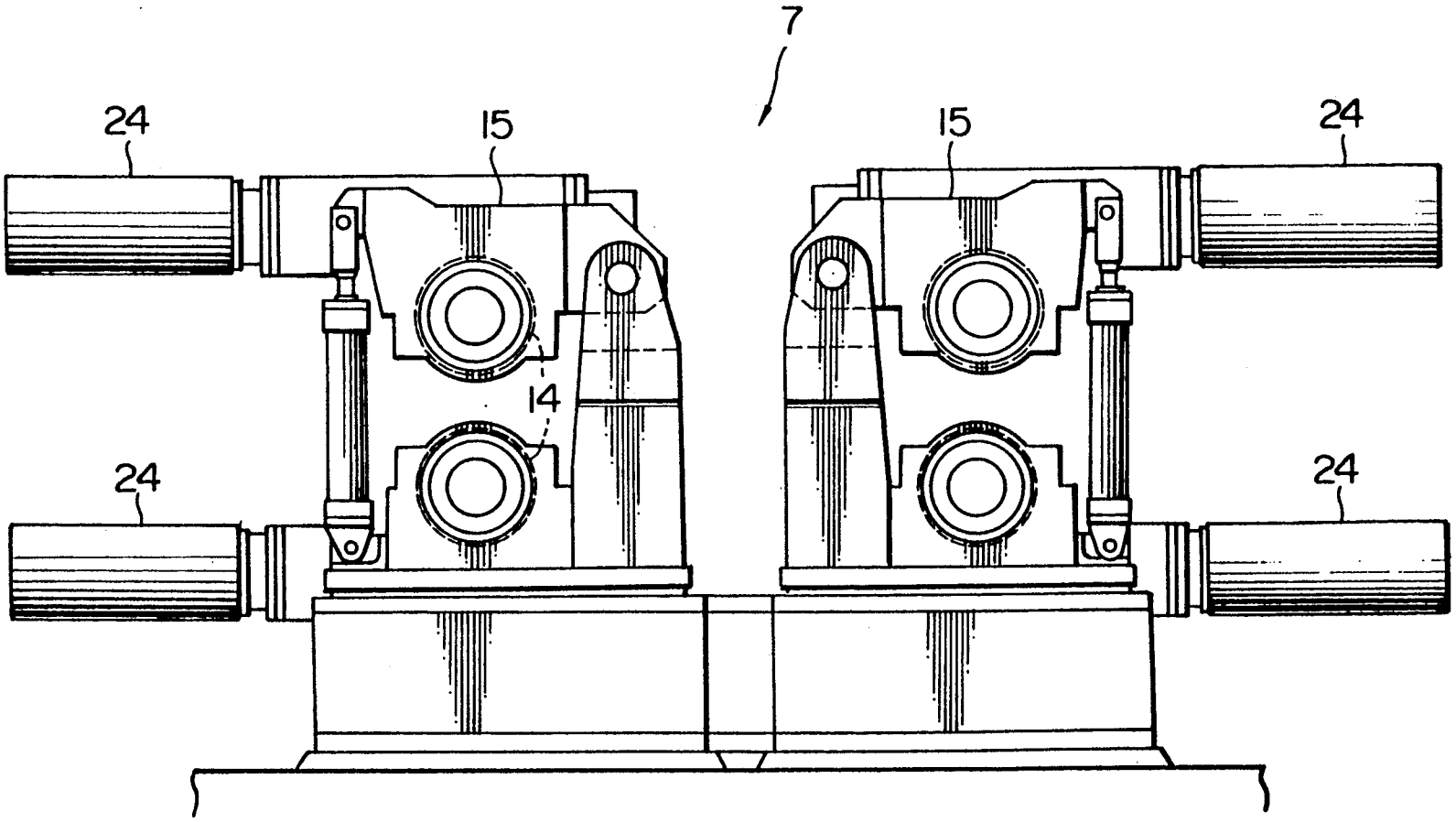
FIG. 15 is a front view showing a modification of the withdrawing device.
Figure 16:
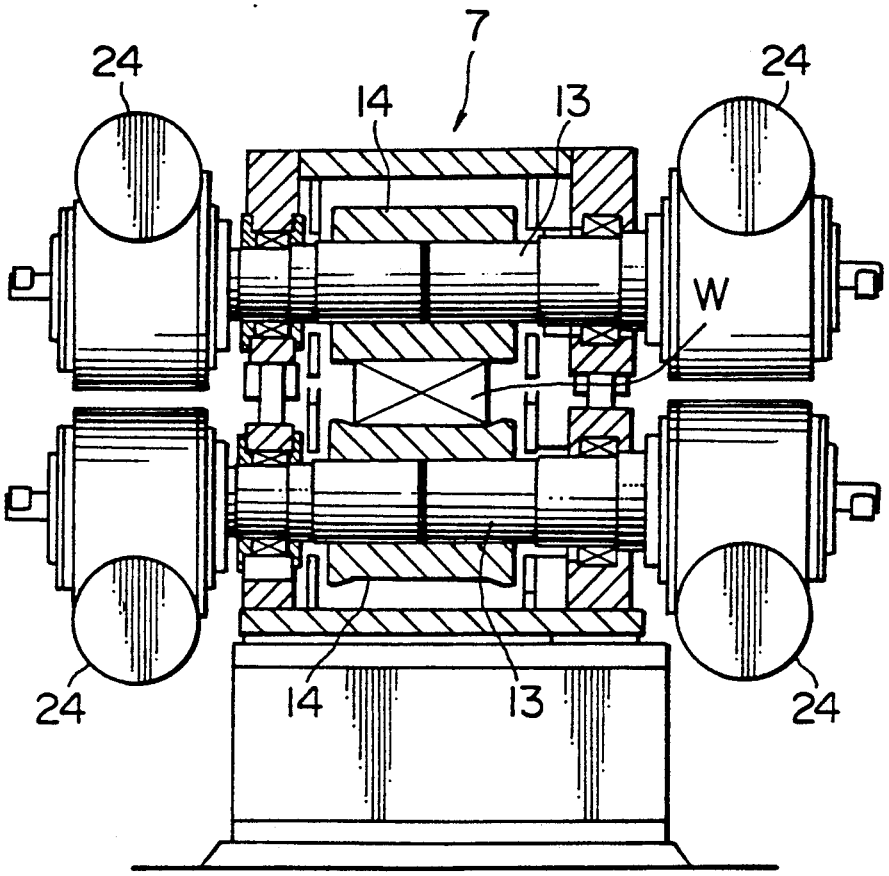
FIG. 16 is a side view, partly in section, showing the withdrawing device shown in FIG. 15.

The withdrawing device may be partially modified as follows Thus, in the case of an apparatus which is used to cast a relatively small size strand W, only one pair of the upper and lower pinch rolls may be provided. Furthermore, the driving device 20 for the upper two pinch rolls 14 may be omitted while the upper two pinch rolls 14 may be made as pressing pinch rolls that follows the movement of the strand W. Although the driving device 20 is provided for only one of the ends of the respective roll shafts 13, the driving devices 20 may be provided for the other ends of the respective roll shafts 13 as shown in FIGS. 15 and 16. Instead of using the AC servomotor 24 and servo control system 40, a DC servomotor and its servo control system or a hydraulic motor and a hydraulic servo control system may also be used. Instead of the rotation restriction mechanism 38 described above, respective motor housings can be connected to the base 11 through connecting members. Furthermore, the downstream side, lower roll may be used for detecting the rotational speed of the pinch roll. Moreover, the strand encoder 45 may be provided at the end of another roll shaft.

Figure 17:
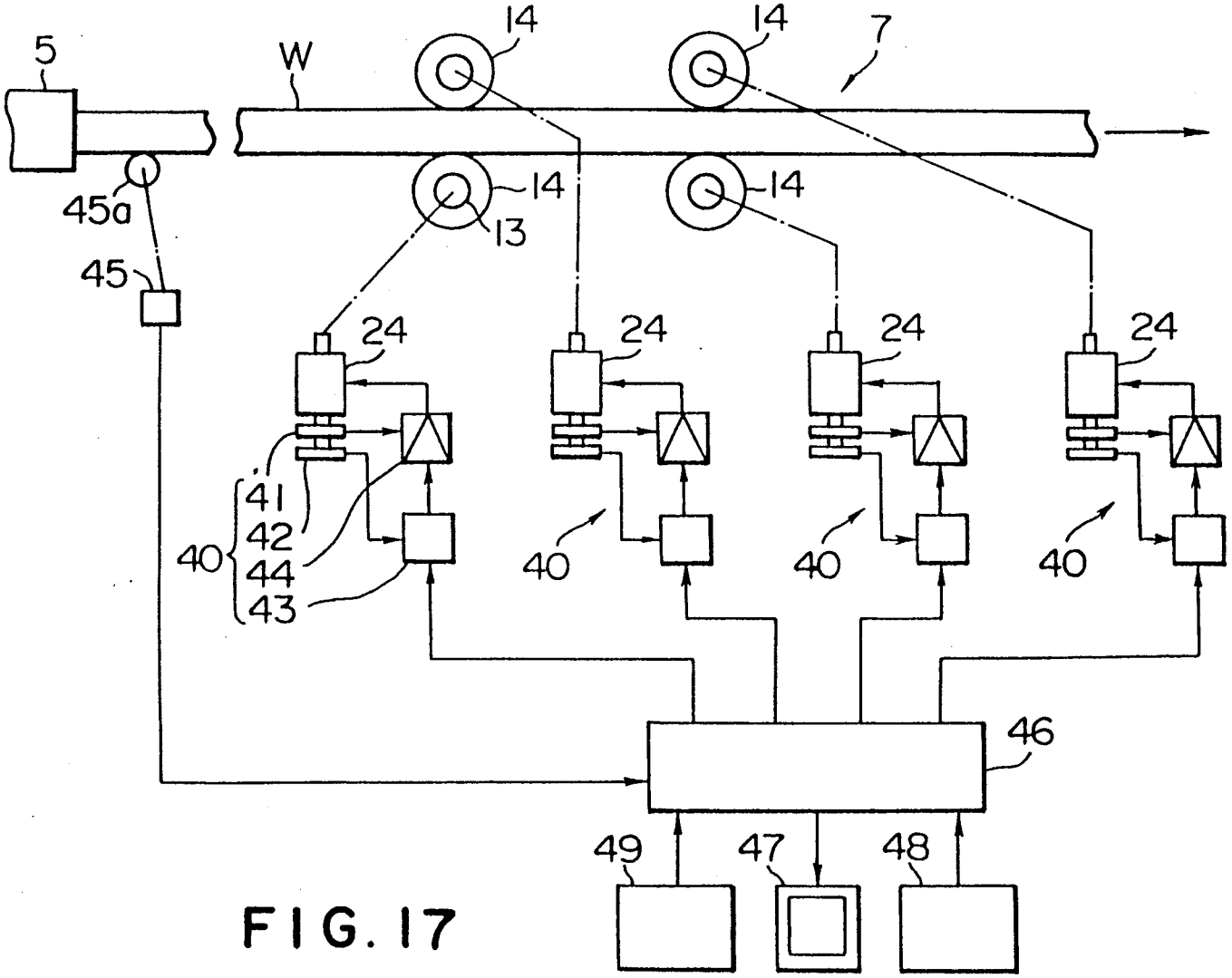
FIG. 17 is a block diagram showing a modified control system for the withdrawing device.

FIG. 17 shows a modified control system of the withdrawing device of this invention. This control system is different from that shown in FIG. 10 in that a roller 45*a* is provided that rotates, following the movement of the strand W, without slip at a position close to the downstream side exit of the mold 5 and that a pulse encoder 45 is provided to detect the rotational angle of the roller 45*a* and a detection signal of the pulse encoder 45 is supplied to the control unit 46. The resolution of the pulse encoder 45 is set to a high value so that a detection signal can be produced even at the time of low speed retraction of the strand.

Figure 18:
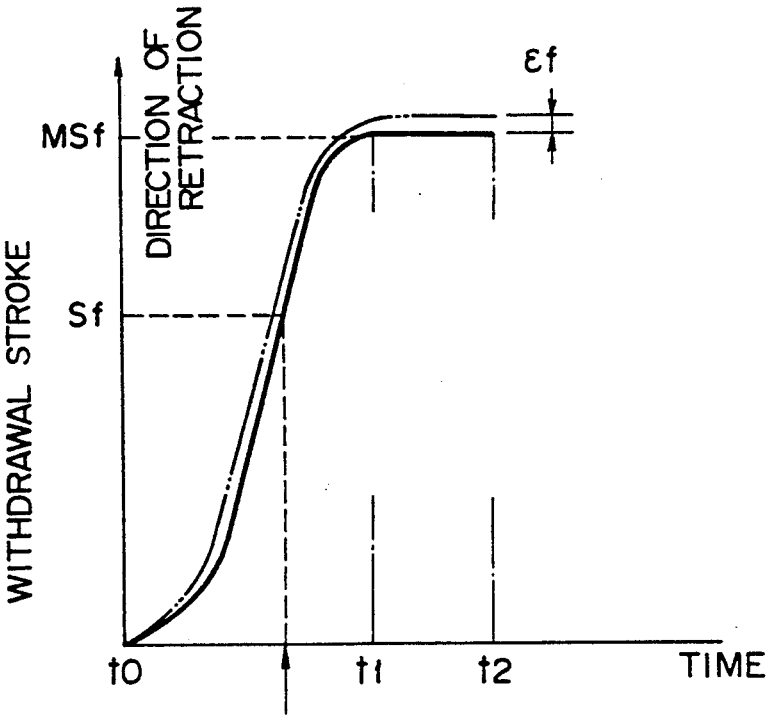
FIG. 18 is a graph showing a withdrawal characteristic of the strand and a delay characteristic in one cycle.
Figure 19:
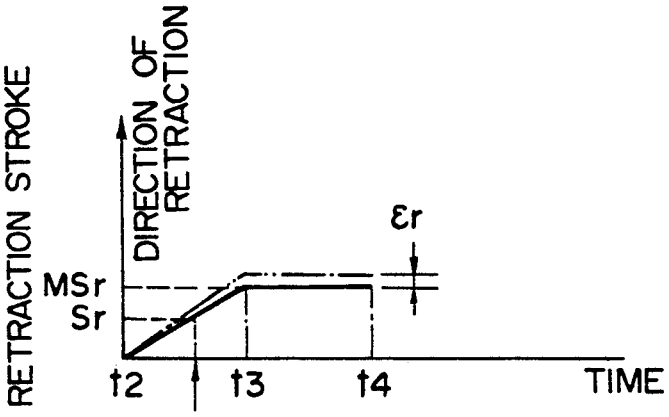
FIG. 19 is a graph showing a strand retracting characteristic and a delay characteristic in one cycle.

A table or a map of the strand withdrawing and retracting characteristic shown by solid lines in the graphs shown in FIGS. 18 and 19 are prestored in the ROM of the control unit 46 together with a control program for controlling the withdrawal of the strand.

The strand withdrawal control effected by this control system is as follows.

Similar to the control system shown in FIG. 10, during the withdrawal, a pulse frequency acting as a speed instruction and a number of pulses acting as a position instruction are calculated at small intervals by the control unit 46 based on the withdrawal stroke characteristic in FIG. 18, and an instruction pulse signal having that pulse frequency and that pulse numbers is supplied to the respective D/A converters 43 of the four servo control systems 40. In each D/A converter 43, a deviation counter contained therein determines the deviation between the number of pulses of the instruction pulse signal and the pulse number outputted from the pulse encoder 42 so that a control signal acting as a speed instruction having a voltage corresponding to the deviation is supplied to the servo-amplifier 44, and the position of the strand W is controlled by the feedback control. In the servo-amplifier 44, a deviation between a control signal received from the D/A converter 43 and the output of the tachometer generator 41 is determined, so that a three phase AC driving current of a voltage proportional to the deviation voltage is supplied to the AC servomotor 24. The speed of the strand is controlled by this feedback control.

For effecting a retraction movement, an instruction pulse is determined at small intervals in accordance with the retraction stroke characteristic in the same manner as described above, and the instruction pulse signal is applied to the D/A converters 43 of the four servo control systems 40, so as to perform feedback controls of the stroke and speed in the same manner as described above.

Figure 20:
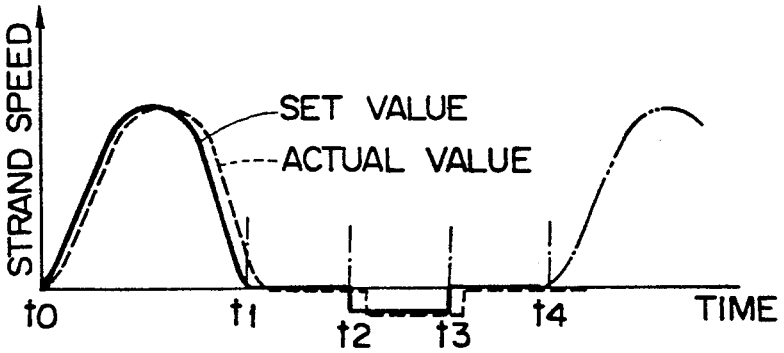
FIG. 20 is a graph showing a speed characteristic of the strand in one cycle.

The moving speed of the strand W at the positions of the pinch rolls 14 tends to delay as shown by dotted line in FIG. 20 relative to the set speed characteristic curve shown by solid line, due to mechanical error factors (backlash, clearances of bearings, and elastic torsional deformation of the shaft members) of the driving device 20, due to error factors caused by delay in electric response of the motor 24 and the servo systems 40, and due to an error factor caused by heat shrinkage of the strand W. That is, the actual speed has a tendency to delay with respect to the set speed characteristic which is set based upon the withdrawal and retraction characteristics of the strand. For this reason, a steady deviation generated by the various factors referred to above is determined at each predetermined number of cycles by using the signal detected by the pulse encoder 45 so as to automatically change, by a learning control of the strand withdrawing and retracting characteristics by taking into consideration the steady deviation.

Figure 21:
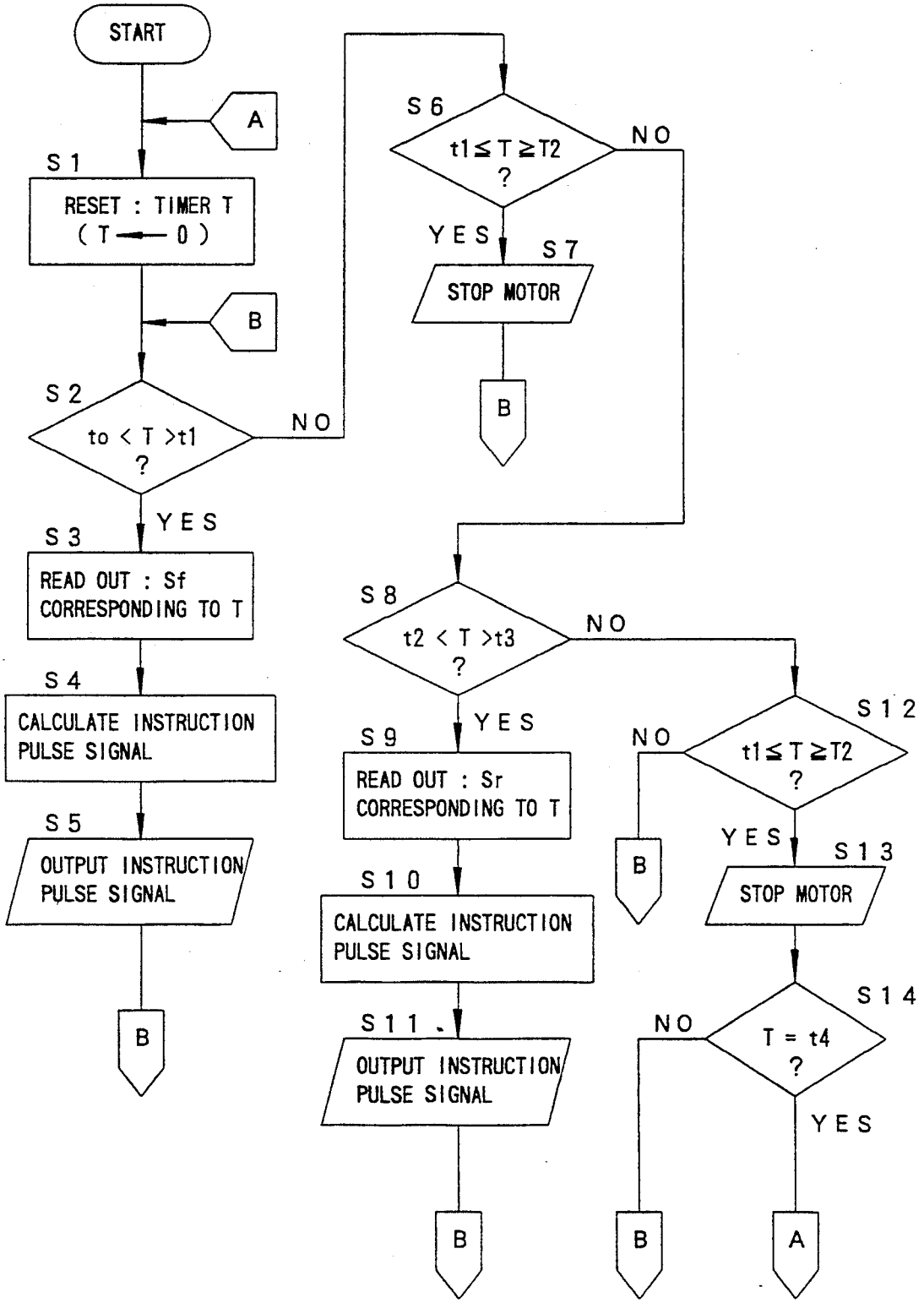
FIG. 21 shows a flowchart of the main routine of the strand withdrawing control.
Figure 22:
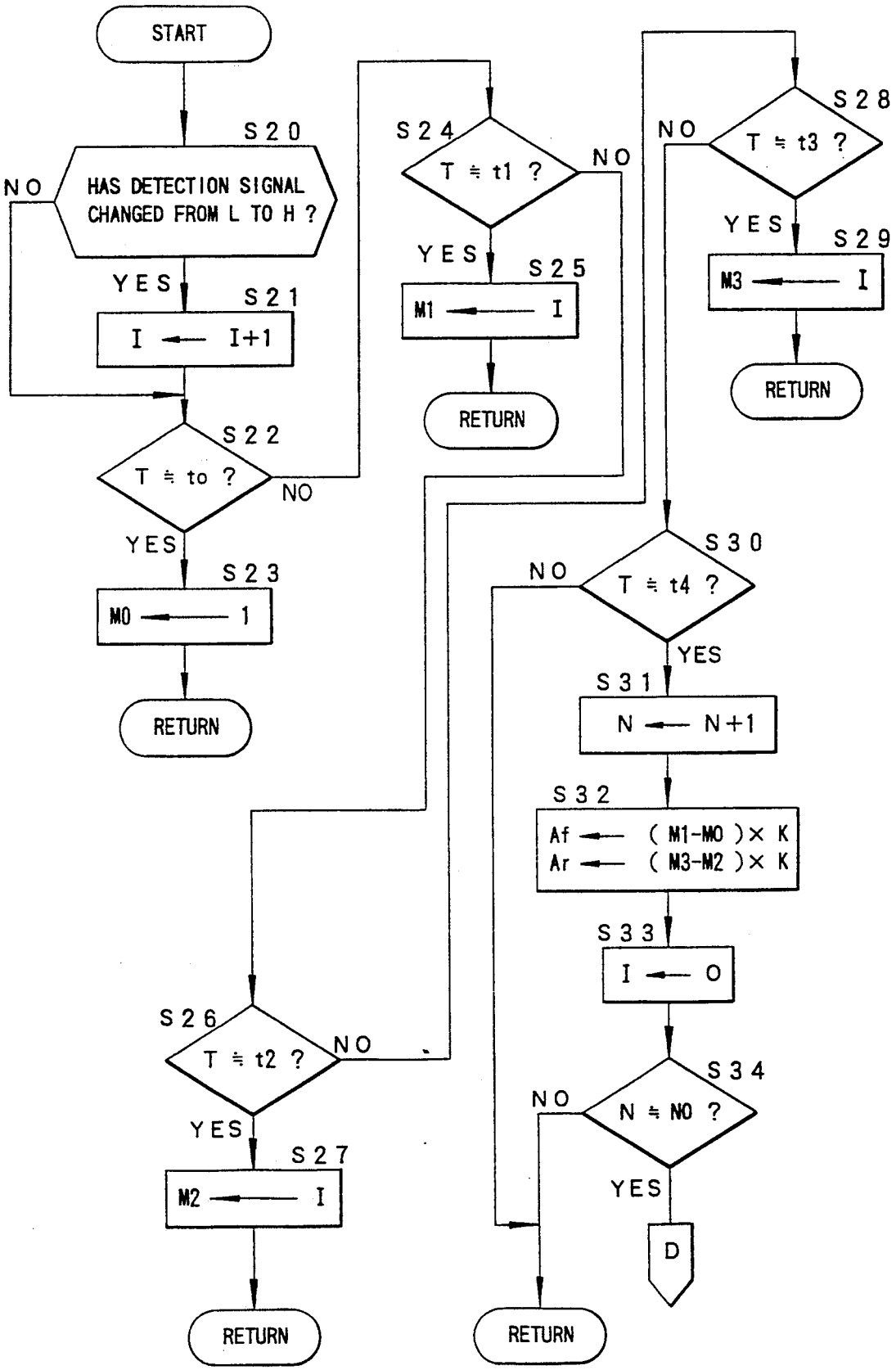
FIG. 22 is a portion of a study controlled flowchart for changing the strand withdrawing and retracting characteristic.
Figure 23:
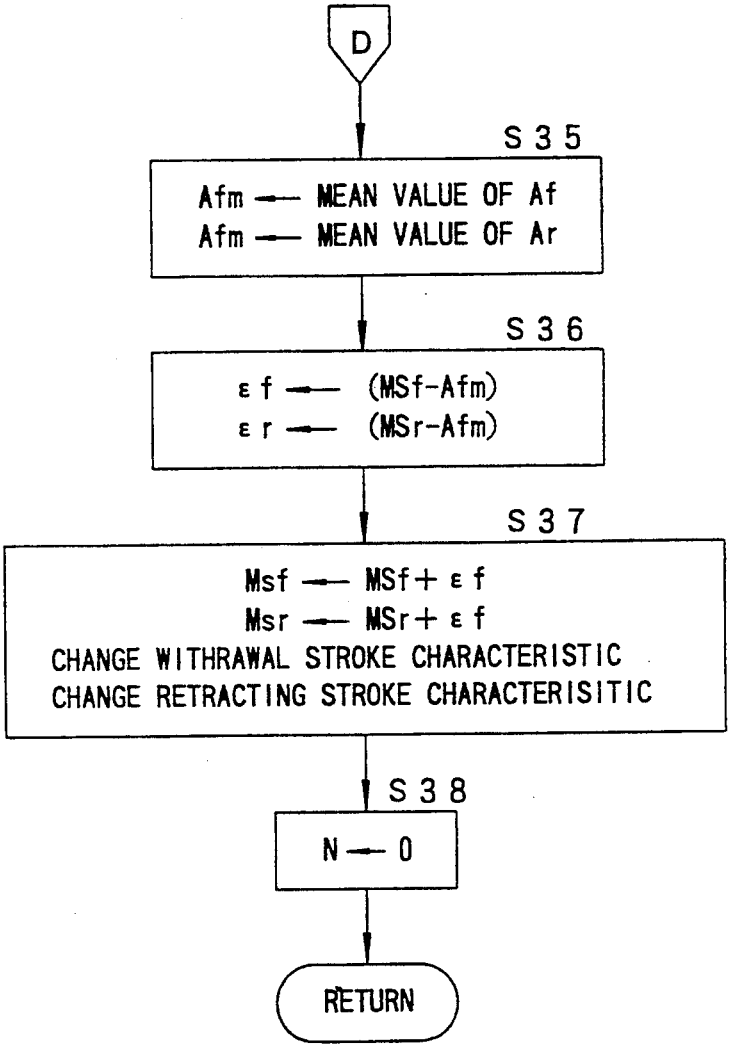
FIG. 23 is a remaining portion of the flowchart shown in FIG. 22.

A strand withdrawing control which controls the withdrawing device in accordance with the withdrawal stroke characteristic of FIG. 18 and the retracting stroke characteristic of FIG. 19 will now be described with reference to the flowcharts shown in FIGS. 21 through 23, in which Si (i=1, 2, . . . ) are respective steps. FIG. 21 shows a main routine repeatedly executed at intervals of one millisecond, while FIGS. 22 and 23 show interruption processing routines executed at intervals of 20 millisecond during the execution of the main routine.

In the flowchart shown in FIG. 21, after starting the control, a timer T (its measuring time is denoted by T) is reset at step S1. The timer T measures the time by counting the number of clock signals. Then, at step 2 a judgment is made as to whether $t_0<T<t_1$. If the result of this judgment is YES, at step S3, a withdrawal stroke Sf corresponding to the timer time T is read out from a table of the withdrawal stroke characteristic of FIG. 18. Then, at step 4, an instruction pulse signal is calculated. At this time, the number of pulses is determined based upon the present withdrawal stroke Sf. Then, by using the previous and present withdrawal strokes Sfs, the speed that is the rate of change of Sf is determined, and the pulse frequency is determined on the basis of the speed thus determined. An instruction pulse signal having this pulse number and this pulse frequency is sent to the four D/A converters 43 at step S5. By repeating this processing, the strand is withdrawn in accordance with the withdrawal stroke characteristic. When this operation is completed, a relation $t_1 \leqq T \leqq t_2$ is obtained. Then, the motor 24 is stopped at step S7, and the motor 24 is maintained at its stopped state until a relation $T=t_2$ is obtained.

Then, when a relation $t_2<T<t_3$ (FIG. 11) is obtained after judging whether a relation $t_2<T<t_3$ is established at step S8, a retracting stroke Sr corresponding to T is read out from a table containing retraction stroke characteristic at step S9. Then, similarly to step S4, an instruction pulse signal is calculated at step S10. Then, similarly to step S5, an instruction pulse signal is outputted at step S11. By repeating this operation, retraction of the strand is carried out based on the retraction stroke characteristic. When a relation $t_3 \leqq T \leqq t_4$ shown in FIG. 11 is established, the operation described above is terminated, the motor 24 is stopped at step S13, and this motor is maintained in a stopped state until a relation $T=t_4$ is established. By executing the foregoing steps S1 through S14, one cycle of the withdrawal of the strand is completed. The strand is withdrawn intermittently by repeating steps S1 through S14.

An interruption processing routine in which the strand withdrawing and retracting characteristic is changed with a learning control by using a detection signal produced by the pulse encoder 45 will now be described below.

As shown in FIG. 22, after starting the interruption, at step S20, a judgment is made as to whether the detection signal of the pulse encoder 45 has built up or not (L→H). Only when the result of the judgment is YES, the number of counts (I) of a counter I counting the number of pulses of the detection signal is incremented by 1 at step S21. Then, when $T \doteqdot t_0$, the number of counts I at this time is stored in a memory M0 (its data content is denoted also by M0 and the same applies to memories M1−M2) at step S23. Thereafter, the processing is returned back to the main routine. At each interruption, the number of pulses of the detection signal is counted by the counter I. After elapse of a given time to a time $T \doteqdot t_1$, the number of counts I at that time is stored at steps S24 and S25. In the same manner, when a relation $T \doteqdot t_2$ holds, the number of counts I at that time is stored in memory M2 at steps S26 and S27. In the same manner when a relation $T \doteqdot t_3$ holds, the number of counts I at that time is stored in memory M3 at steps S28 and S29. When one cycle of operation is completed at a time of $T \doteqdot t_4$, the number of counts of a counter N counting the number of cycles is incremented by 1 at step S31. The counter N is reset to N=0 at the start of the main routine. Then, the actual stroke Af of the strand W at the time of withdrawal, and the actual stroke Ar of the strand W at the time of retraction are calculated by equations Af→(M1−M0)×k and Ar→(M3−M2)×k (k is a constant) at step S32, and these actual strokes are stored in memory devices. Even when the movement of the strand W is changed from withdrawal to retraction, the counter I repeats its incrementing operation after resetting the counter I at step S33, and when the count of the counter N reaches a predetermined value No (for example, No=5 to 10), the execution is transferred from step S34 to step S35, for calculating a mean value Afm of No·Af which have been stored in the memory devices as well as a mean value Arm of No·Ar at step S35. Then, the mean value Afm is subtracted from a preset total strokes Msf in the present withdrawal stroke characteristic of the withdrawing movement, for calculating the deviation $\epsilon f$ of the withdrawing stroke. In the same manner, the mean value Arm is subtracted from a preset total stroke Msr of the present retracting stroke characteristic during the retraction movement, for calculating the deviation $\epsilon r$ of the retracting stroke, at step S36. Then, by changing Msf to (Msf+$\epsilon f$) and by performing an interpolation calculation between times $t_0$ and $t_1$, the withdrawal stroke shown in FIG. 12 is changed to that shown by the chain lines. Furthermore, by changing Msr to (Msr+$\epsilon r$) and by performing an interpolation calculation between times $t_2$ and $t_3$, at step S37, the retracting stroke characteristic shown in FIG. 19 is changed to a characteristic shown by the chain lines. During an interval of N=1∼No, Msf and Msr are constant. Then, at step S38, the counter N is reset and then the processing returns to the main routine. Since Msf and Msr are constant during the interval of N=1−No, calculations of deviations (Msf−Af) and (Msr−Ar) at respective cycles are not described, but it is also possible to calculate the deviations at respective cycles and store the calculated deviations in memories for calculating $\epsilon f$ and $\epsilon r$ from this mean values when N=No.

By effecting a learning control in which the changing processing of the strand withdrawing and retracting characteristic of the strand shown in FIGS. 22 and 23 is repeated at each No cycles, it becomes possible to converge the strand withdrawing and retracting characteristics, to a desired withdrawing and retracting characteristics by taking into consideration normal deviations generated by mechanical error factors of the withdrawing device, an electrical error factor and an error factor of the heat shrinkage of the strand W, whereby the withdrawal accuracy of the strand can be substantially improved. As the strand withdrawing and retracting characteristics are different for the types of the strand W, it is possible to make adequate the present strand withdrawing and retracting characteristics now being used in a relatively short time by the learning control described above.

In this embodiment, the pulse encoder 45 for detecting the amount of movement of the strand W is provided near the outer side of the exit opening of the mold 5, so that a detection signal correctly representing the amount of movement of the strand in the mold 5 can be generated. By calculating the mean value of a plurality of cycles of these detection signals, a learning control can be performed in which constant errors $\epsilon f$ and $\epsilon r$ caused by mechanical and electrical error factors are determined for changing the withdrawing and retracting characteristics so that the strand W can be moved with a characteristic extremely close to the preset strand withdrawing and retracting characteristics, whereby the quality of the strand is greatly improved. The detection signal of the pulse encoder 45 may be supplied to the D/A converters 43 of the respective servo control systems 40. In this case, however, an abnormal deviation caused by the sticking of the strand W in the mold 5 is fed back, so that the stability of the servo control system 40 is deteriorated. In the control of this embodiment there is no such problem.

Figure 24:
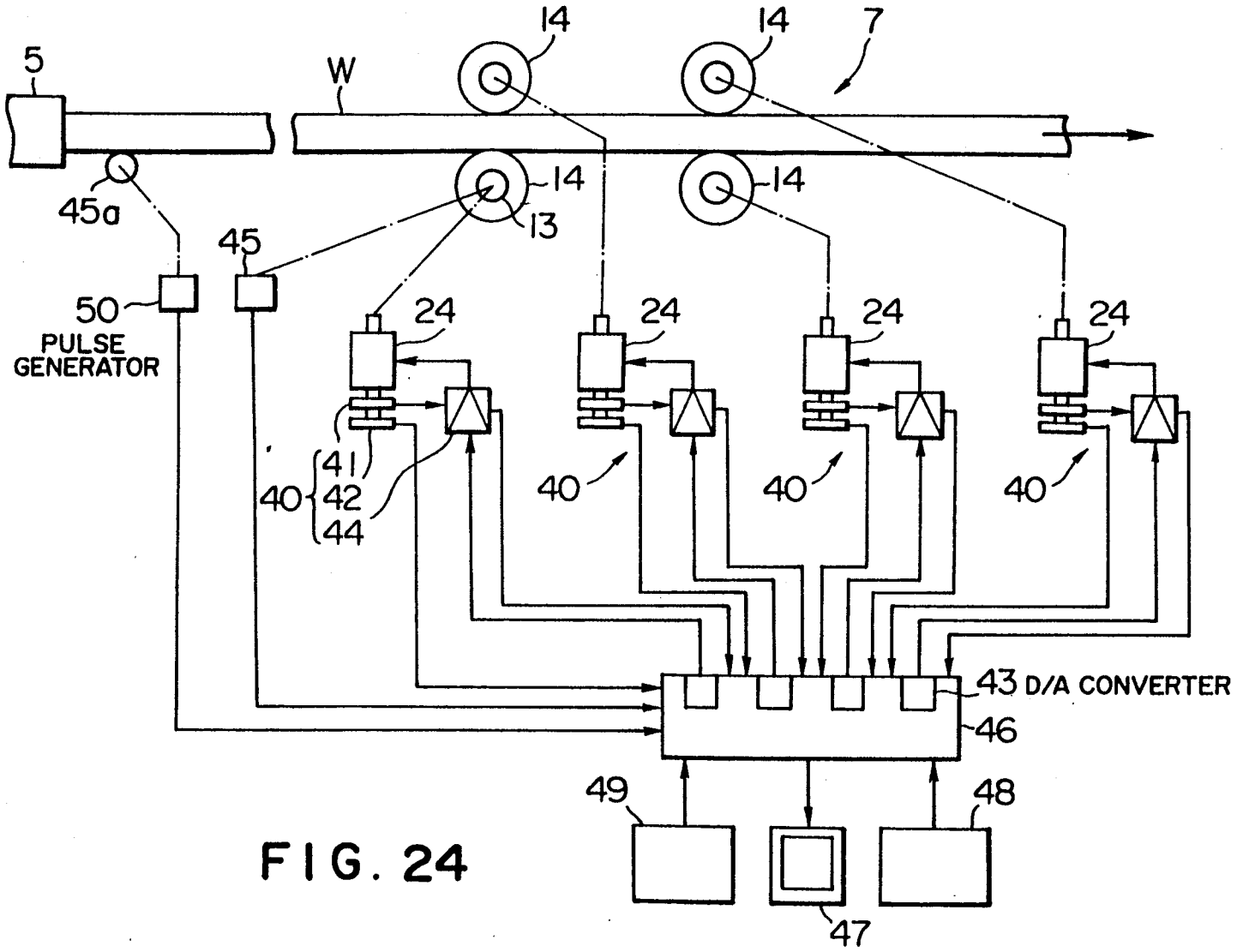
FIG. 24 is a block diagram showing a further modification of the control system of the withdrawing device.

FIG. 24 is a block diagram showing another control system for the strand withdrawing device according to this invention. In this modified control system, the control unit 46 includes D/A converters 43 corresponding to the four servo control systems 40. The rotational angle signals of the pulse generators 42 of the respective servo control systems 40 are applied to the control unit 46 so that control signals are supplied to corresponding servo-amplifiers 44 from the respective D/A converters 43. The rotational angle output signals of the pulse generators 42 of the respective servo control systems 40 are supplied to the control unit 46 for outputting control signals to corresponding servo-amplifiers from the respective D/A converters 43. The output of the pulse generator 42 adapted to detect the rotational angle of the motor 24 for rotating the lower pinch roll 14 at the downstream side is used for controlling the withdrawal of the strand in the control unit 46, whereas the outputs of the other three pulse generators 42 are respectively used for displaying the rotational speed of the corresponding AC servomotors 24 by display devices 47.

There is also provided a pulse generator 45 for detecting the rotational angle of the roll shaft 13 of the lower pinch roll 14 at the upstream side, and the output of the pulse generator 45 is supplied to the control unit 46. Furthermore, there is provided a control roll **45*a* driven by the strand W without slip near the exit opening of the mold 5. There is also provided a pulse generator 50 for detecting the rotational angle of the control roll 45*a*, the output of the pulse generator 50 being supplied to the control unit 46. The pulse generators 45 and 50** produce high resolution outputs so as to produce detection pulse signals at intervals of about 10 through 20 μm even during low speed retracting motion.

Each servo-amplifier 44 is incorporated with a current detector in the form of a current transformer which detects the driving current supplied to the motor 24 and its detected current signal is sent to the control unit 46.

In the ROM of the microcomputer of the control unit 46 are prestored control programs for controlling strand withdrawal by four servomotors in accordance with the strand withdrawing and retracting characteristics preset for the types of the strand W, in the same manner as in the foregoing embodiment. Further, the ROM is prestoring an abnormality diagnosis control program accompanying the strand withdrawal control.

Figure 12:
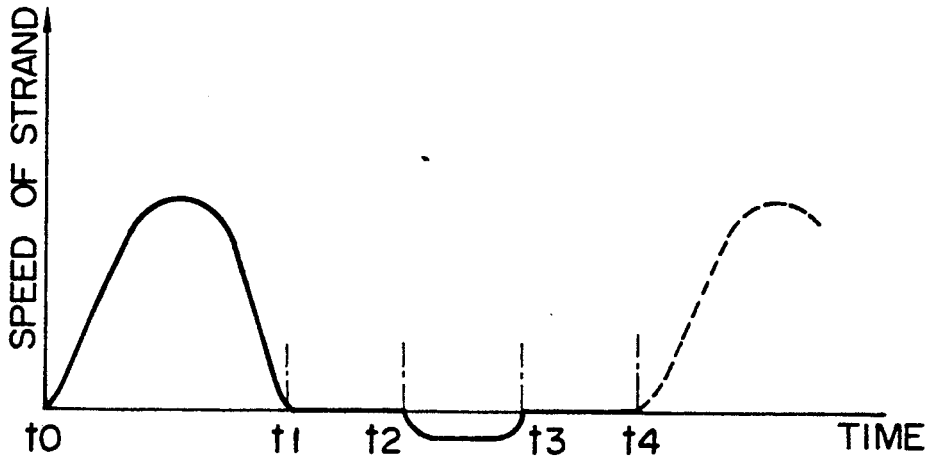
FIG. 12 is a graph showing a speed characteristic of the strand in one cycle.

A table or map regarding withdrawing and retracting of the strand shown in FIGS. 11 and 12 is prestored in the ROM together with a program for controlling the withdrawal of the strand.

The strand withdrawing control will now be described below. In the control unit 46, are calculated and determined a speed instruction and a position instruction in accordance with the withdrawal stroke characteristic contained in the strand withdrawing and retracting characteristics at each small time. The control unit 46 calculates a speed control instruction such that the deviation between the position instruction and the detection position contained in the output signal of the pulse generator 42. This speed control instruction is applied to the respective D/A converters 43, and each D/A converter 43 supplies a control signal corresponding to the speed control instruction to each servo-amplifier 43.

Each servo-amplifier 43 generates a three phase alternating current which eliminates the deviation between the control signal and a detection signal representing the speed signal from the tachometer generator 41, and this three phase alternating current is applied to the servomotors 24. In this manner, a feedback of the position and the speed to the AC servomotors is performed.

In the same manner as above described, at the time of retracting the strand, a speed instruction and a position instruction are determined at each small time based on the retracting characteristic included in the strand withdrawing and retracting characteristic so that the position and speed signals are fed back to the AC servomotors 24.

It is also possible to eliminate the four tachometer generators 41 and to determine, in the control unit 46, an instruction that controls the position and speed of the AC servomotors 24 based on the output signal of the pulse generator and the strand withdrawing and retracting characteristics so as to apply a control signal corresponding to the instruction to the four servo-amplifiers.

Figure 25:
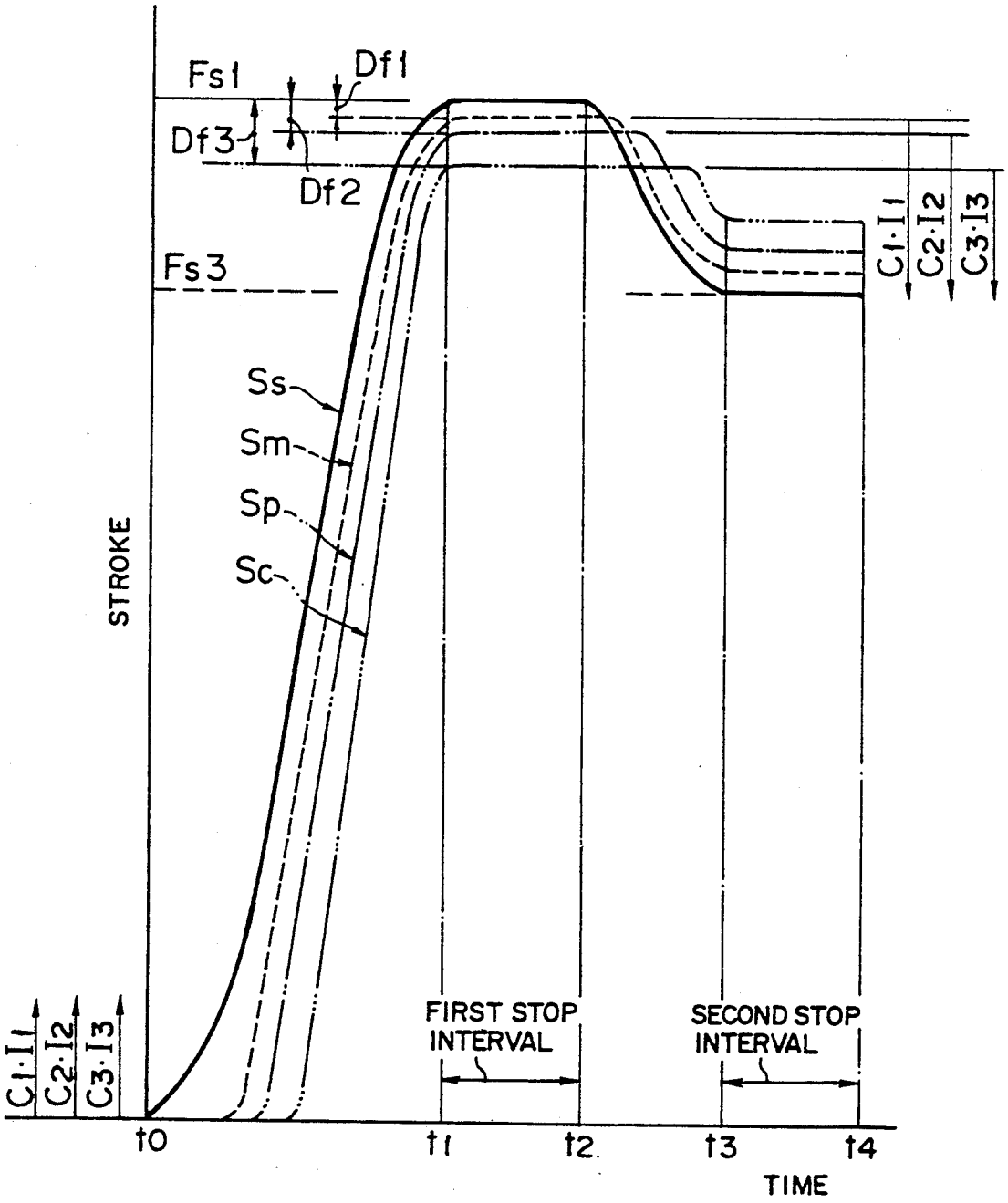
FIG. 25 is a time chart showing a strand withdrawing and retracting characteristic, a detection stroke of a motor, a detection stroke of pinch rolls, and a detection stroke of a control roll in one cycle.

Due to mechanical error factors (backlash, clearances of bearings, elastic torsional deformation of shaft members), an error factors caused by the delay of electric response of the servomotor 24 and the servo control system and the error factor caused by the heat shrinkage of the strand, a stroke obtained by converting the rotational angle of the servomotor 24 detected by the pulse generator 42, the rotational angle of the pinch roll 14 detected by the pulse generator 45, and the rotational angle of the control roll **45*a* detected by the pulse generator 50, into the amount of movement of the strand W will delay or decrease than the strand withdrawing and retracting characteristics Ss as shown in FIG. 25**.

In the withdrawing device 7 of this embodiment, deviation data between the strand withdrawing and retracting characteristics Ss and the stroke Sm of the servomotor 24, between the characteristic Ss and the stroke Sp of the pinch rolls 14, and between the characteristic Ss and the stroke Sc of the control roll 45a, and current data of the driving motor immediately before the termination of the first and second pause periods $t_1-t_2$ and $t_3-t_4$ are determined. By statistically processing these data, it is possible to diagnose, at a real time, abnormal conditions of the withdrawing device 7.

The strand withdrawing control in which the strand W is driven according to the strand withdrawing and retracting characteristics shown in FIG. 11 and an abnormal condition diagnosis control will now be described with reference to the flowcharts shown in FIGS. 26 to 29.

Figure 26:
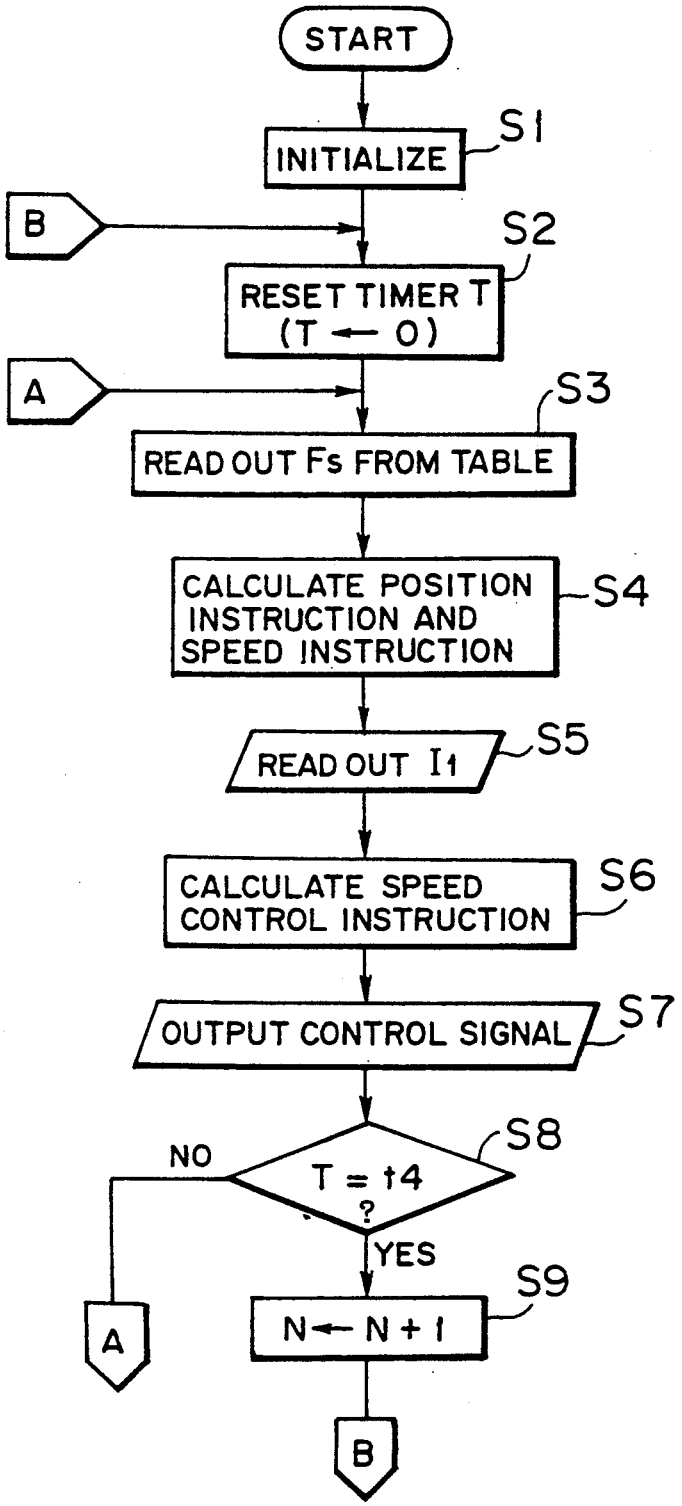
FIG. 26 is a flowchart of a main routine of the strand withdrawing control.

FIG. 26 shows a routine of the strand withdrawing control executed in one millisecond, for example. When the control is started, an initialization step is executed at step S1 for clearing the memories stored in the RAM and the counter. Then, a timer T (its measuring time is represented by T) in the form of a counter which counts the number of clock signals is reset at step S2. Then, a stroke $F_s$ is read out at step S3 from a table of the strand withdrawing and retracting characteristic, and a position instruction and a speed instruction are calculated at step S4. Based on this stroke $F_s$, at step S5, the count value 11 of a counter $I_1$ to be described later is read out from the RAM. At step S6, a speed control instruction is calculated based on the $C_1 \cdot I_1$ (where $C_1$ is a proportionality constant) obtained by converting the count value $I_1$ into a stroke. Then, at step S7, control signals corresponding to the speed control instructions are sent from the respective A/D converters 44 to the servo-amplifiers 43. At step S8, a judgment is made as to whether $T=t_4$ or not. When the result of the judgment is No, the program is returned back to step S3 for repeating back to step S3 for repeating steps S3 through S8. Upon completion of the strand withdrawal corresponding to one cycle of processings, a condition of $T=t_4$ is reached. At step S9, the count of a counter N counting the number of the strand withdrawal cycles is incremented by 1. Then, the program is returned to step S2. Thereafter, step S2 through S9 are repeated for carrying out the continuous casting.

Figure 27:
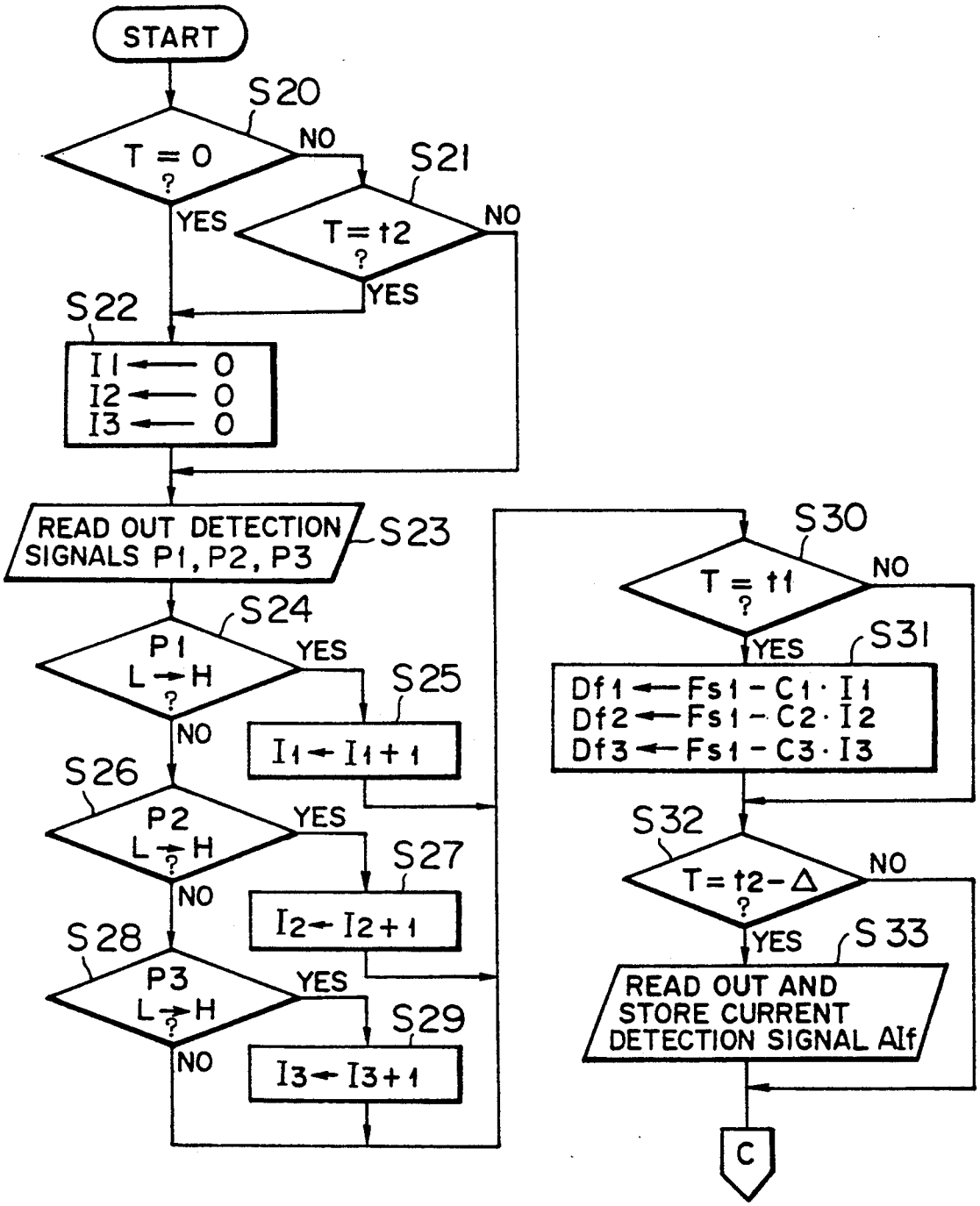
FIG. 27 shows a portion of an abnormal condition diagnosis controlling flowchart accompanying the strand withdrawing control.
Figure 28:
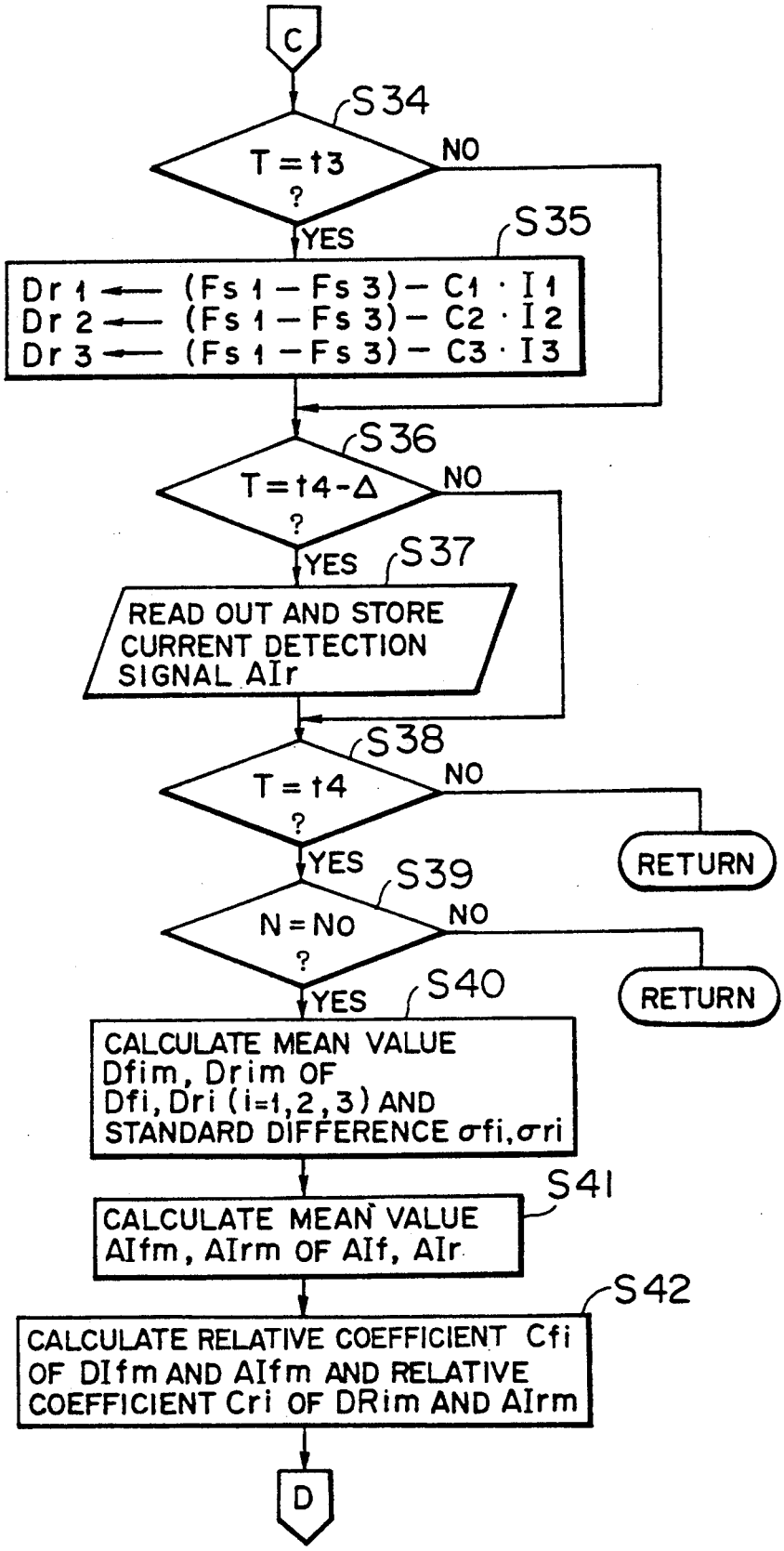
FIG. 28 is a continuation of the flowchart of the abnormal condition diagnosis control.
Figure 29:
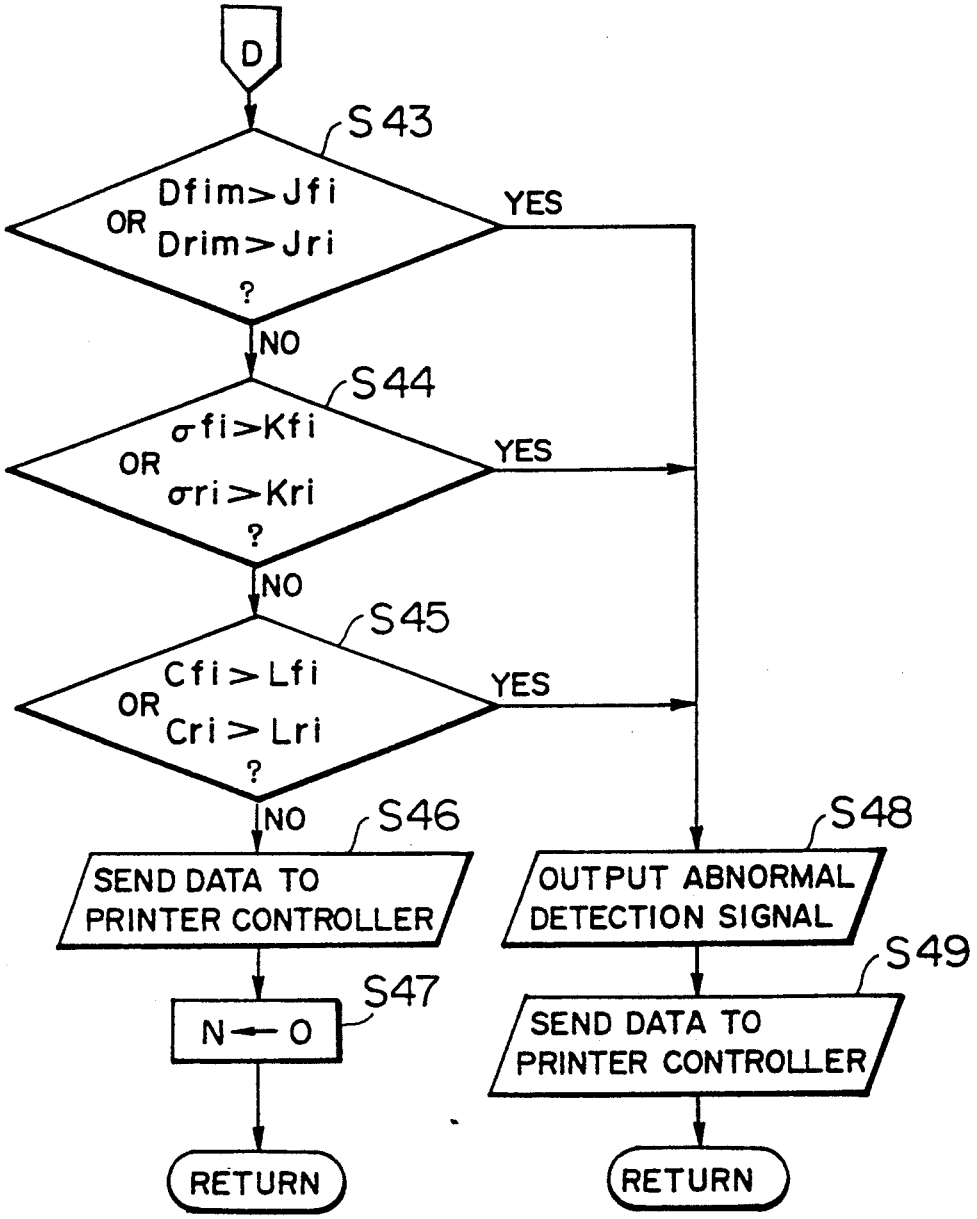
FIG. 29 is a further continuation of the flowchart shown in FIG. 28.

FIGS. 27 through 29 show an abnormal condition diagnosis control routine executed by an interruption at intervals of one millisecond, for example. After starting the interruption, only when T=0 or T=2 (steps S20 and S21), counters $I_1$, $I_2$ and $I_3$ (their counts are denoted by I1, I2 and I3, respectively) which respectively count the number of pulses of the pulse generators 42, 45 and 50, are reset at step S22. Then, detection signals $P_1$, $P_2$ and $P_3$ of the pulse generators 42, 45 and 50 are written at step S23. Only when the detection signals $P_1-P_3$ build up from L to H, the counts of the corresponding counters are respectively incremented by 1 at steps S24 through S29.

Then, when $t=t_1$, that is when the strand withdrawal is completed, deviations Df1, Df2 and Df3 are calculated at step S31. More particularly, as shown in FIG. 25, when denoting by $F_{s1}$ the set stroke when $T=t_1$ and denoting by $C_1$, $C_2$ and $C_3$ the proportionality constants for converting into strokes the number of pulses $I_1$, $I_2$ and $I_3$ of detection signals $P_1$, $P_2$ and $P_3$, the deviation Df1 between the set withdrawing stroke $F_{s1}$ and the stroke $C_1 \cdot I_1$, the deviation Df2 between the set withdrawing stroke $F_{s1}$ and the stroke $C_2 \cdot I_2$ determined by the pulse generator 45, and the deviation Df3 between the set withdrawing stroke $F_{s1}$ and the stroke $C_3 \cdot I_3$ determined by the pulse generator 50 are respectively calculated by equations $F_{s1}-C_1 \cdot I_1$, $F_{s1}-C_2 \cdot I_2$ and $F_{s1}-C_3 \cdot I_3$ shown by step S31, and the results of the calculations are respectively stored in the registers of RAM.

At the time of $T=t_2-\Delta$ ($\Delta$ is a predetermined small time), that is, at a time point immediately prior to the completion of the first pause time $t_1-t_2$, it is judged whether $T=t_2-\Delta$, and when the result of the judgment at step S32 is YES, a signal AIf representing the driving current of the Ac servomotor 24 is read out and stored in a register of the RAM at step S33. At the time shown by $T=t_2-\Delta$, the driving current caused by the instruction pulse signal is zero, but a small driving current flows due to control to resist heat shrinkage of the strand between the mold 5 and the withdrawing device 7 in the servo control system 40.

At the time of $T=t_2$ (S21, YES), that is, at the time of starting the retraction stroke, the counters $I_1$, $I_2$ and $I_3$ are reset at step S22 so that in the period of $I_2<T<t_3$, the counters $I_1$, $I_2$ and $I_3$ show the accumulated values of the number of pulses at the time of the strand retraction. At the time of $T=t_3$ (S34, YES), that is, at the time of completion of the retraction, deviations Dr1, Dr2 and Dr3 are calculated at step S35. As shown in FIG. 25, when a stroke set at a time of $T=t_3$ is denoted by $F_{s3}$, the set stroke of the retraction is expressed by $(F_{s1}-F_{s3})$. As a consequence, the deviation Dr1 between the set retraction stroke $(F_{s1}-F_{s3})$ and the stroke $C_1 \cdot I_1$ generated by the pulse generator 42, the deviation between a set retraction stroke $(F_{s1}-F_{s3})$ and the stroke $C_2 \cdot I_2$ generated by the pulse generator 45, and the deviation between a set retraction stroke $(F_{s1}-F_{s3})$ and the stroke $C_3 \cdot I_3$ caused by the pulse generator 50 are calculated by equations shown at step S35 and these equations are stored in the respective registers of the RAM.

At the time of $T=t_4-\Delta$, that is, at a point immediately before the end of the second pause interval $(t_3-t_4)$, a current detection signal AIr is read out and then stored in a register of the RAM at step S37. In the same manner as above described, the driving current detected at this time is caused to flow due to heat shrinkage of the strand W. At step S38, a judgment is made as to whether $T=t_4$, that is, whether the retraction stroke of the strand W of one cycle has been completed or not. When the result of the judgment is No, the program is returned to the main routine, whereas when the result of the judgment is YES at step S39, a judgment is made as to whether the counter N becomes a desired set value No (for example No=5~10), in other words whether the number of the cycles required for withdrawing the strand has reached No or not. When the result of the judgment is No, the program is returned to the main routine, while when the result of the judgment is YES, steps S40 and following steps are executed.

At step S40, the mean values Dfim and Drim of the deviations Dfi and Dri (where i=1, 2, 3) corresponding to No cycles, which have been stored in the register, are calculated and standard deviations $\sigma$fi and $\sigma$ri are also calculated, while the mean values AIfm and AIrm of the driving currents AIf and AIr, which have been stored in the register are calculated at step S41. The relative coefficient Cfi between Dfim and AIfm, and the relative coefficient Cri between Drim and AIrm are calculated at step S42.

Then, at step S43, a judgment is made as to whether the mean values Dfim and Drim of the deviations are larger than predetermined permissible values Jfi and Jri. When any one of the mean value among six mean values is larger than the permissible value, the program is transferred to step S48, while when all the mean values are smaller than the permissible values, the program is transferred to step S44. Then, at step S44, a judgment is made as to whether the standard deviations $\sigma$fi and $\sigma$ri are larger than their predetermined permissible values Kfi and Kri. When any one of the standard deviation among six standard deviations is larger than its permissible value, the program is transferred to step S48, while when all the standard deviations are smaller than their permissible values, the program is transferred to step S45. Then, at step S45, a judgment is made as to whether relative coefficients Cfi and Cri are larger than the predetermined permissible values Lfi and Lri. When the six relative coefficients are larger than the permissible values, the program is transferred to step S48, while when all the relative coefficients are smaller than their permissible values, as the strand withdrawal is being correctly performed. At step S46, various data described above, including the deviations between their mean values, and the standard value, current values, the mean value of the relative coefficients, etc. are applied to the printer controller. Then, at step S47, the counter N is reset, and the program is returned to the main routine.

If the result of the judgment is YES at any one of the steps S43, S44 and S45, it shows that the withdrawal of the strand is not being performed adequately. In more detail, this means that any one of the mechanical system or the control system of the withdraw device 7 is abnormal or that the strand W sticks to the mold 5. Therefore, at step S48, an abnormality information signal is issued, that is, a warning lamp on the control panel 49 is lit or an alarm buzzer is operated. Furthermore, various data similar to those of step S46 are sent to the printer controller at step S49, and the program is returned to the main routine. In this case, the value of counter N is held so that even when the casting operation is continued, the processing at step S48 will be repeated in the next interruption.

In this embodiment, it is possible to positively detect at an early stage such abnormal conditions in which the servomotors 24 and the pinch rolls 45*a* do not adequately operate in their permissible error ranges with reference to the strand withdrawing and retraction characteristic. Where abnormal conditions are detected, the operator can make suitable coping operations.

Furthermore, as it is possible to process a large quantity of data automatically and rapidly at real times by means of the control unit 46 in parallel with the strand withdrawing control, it is possible to prevent production of a great length of strand W of poor quality by casting under abnormal conditions. Thus it is possible to greatly reduce the cost of analyzing detected data in a large quantity.

In horizontal continuous casting installations of the type described above, at the stage of initial solidification in the mold, the solidifying shell of the molten metal is sometimes broken during solidification, which is called a breakout. This phenomenon causes leakage of the molten metal which damages the mold. A withdrawing apparatus capable of preventing beforehand such breakout and leakage of the molten metal will be described below.

Figure 30:
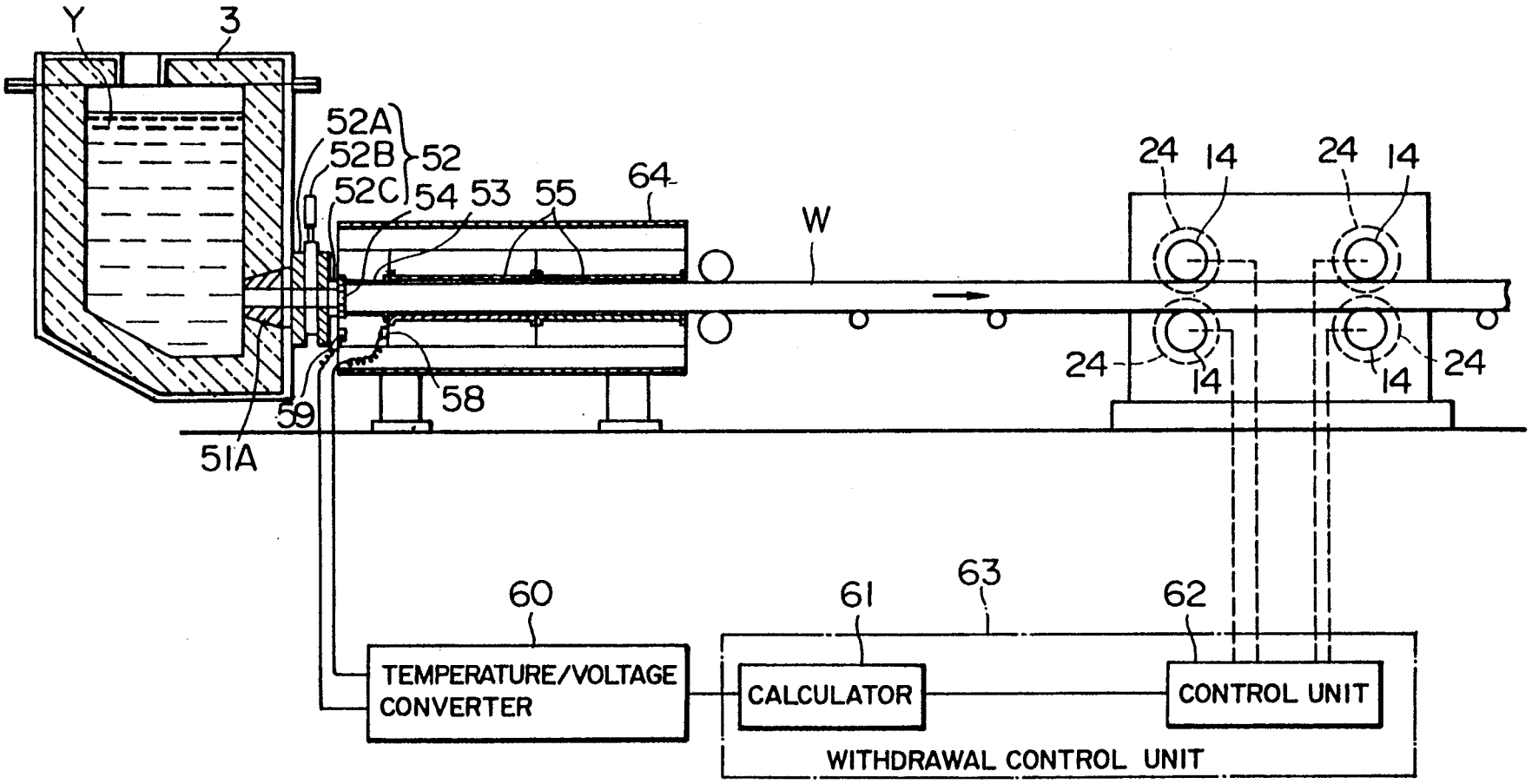
FIG. 30 is a side view, partly in blocks, showing a horizontal continuous casting installation utilizing an adjustable mold and its withdrawal control system.
Figure 31:
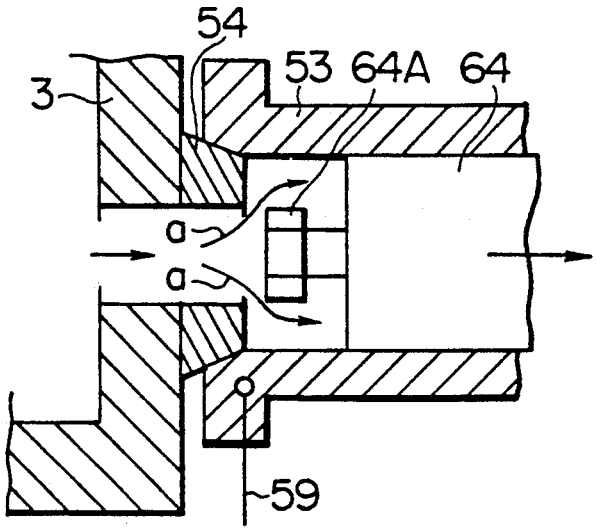
FIG. 31 is a longitudinal sectional view of a mold tube inlet portion showing a state at the time of commencement of the strand withdrawal.

FIG. 30 illustrates a horizontal continuous casting installation utilizing a strand withdrawing device having an adjustable mold. The casting installation comprises a tundish 3 containing molten metal Y, and a gate 52, a housing 52A thereof being mounted on the outer surface of the molten metal outlet opening 51A of the tundish 3 and provided with a sliding gate 52B and a feed nozzle 52C. There is provided a stationary mold tube 53 functioning as a strongly cooling portion. The mold tube 53 has substantially the same cross-sectional configuration as the crosssection of the strand. The stationary mold tube 53 is made of a copper alloy and its outer surface is cooled by water. As shown in FIG. 31, at the inlet end of the stationary mold tube 53 is fitted a break ring 54 made of ceramic and having an outer diameter smaller than the inner diameter of the mold tube 53. As shown in FIG. 30, an adjustable mold 55 is provided at the downstream side of the stationary mold tube 53. The adjustable mold 55 is lined with a high lubricative carbon and is divided into a plurality of sections in the circumferential direction so as to act as a gentle cooling portion movable in radial directions. Pinch rolls 14 are respectively rotated by driving motors 24 for intermittently withdraw the strand W in a direction shown by an arrow. The stationary tube 53 and the adjustable mold 55 are contained in a mold housing 64.

The temperature detecting end of a first thermocouple 58 is installed at the exit end of the stationary mold tube 53. A plurality of spaced apart thermocouples 58 are provided along the periphery of the mold tube 53 for monitoring and detecting the temperature of the stationary mold tube 53. The temperature detecting end of a second thermocouple 59 is secured to the back surface of the break ring 54 at the inlet end of the stationary mold tube 53. The purpose of the second thermocouple 59 is to monitor the initial solidification state of the molten metal by sensing the temperature at the back portion of the break ring 54 in the stationary mold tube 53. A plurality of thermocouples 59 are provided in spaced apart relation in the circumferential direction. As shown in FIG. 30, detected temperature signals from the first and second thermocouples 58 and 59 are supplied to a temperature/voltage converter 60 and outputted therefrom as a voltage signal.

A withdrawal control unit 63 comprises a calculator 61 which in response to the output from the temperature/voltage converter 60 performs a calculation of a value which is a function of time, representing the initial solidification step and a normal withdrawing step, thereby outputting a control signal which is applied to a control unit 62 for controlling pinch roll driving motors 24. In response to the control signal issued from the calculator 61, the control unit 62 controls the rotations of the driving motors 24 and the pinch rolls 14.

The withdrawing operation of the withdrawing device of the horizontal continuous casting installation constructed as above described operates as follows.

Figure 32:
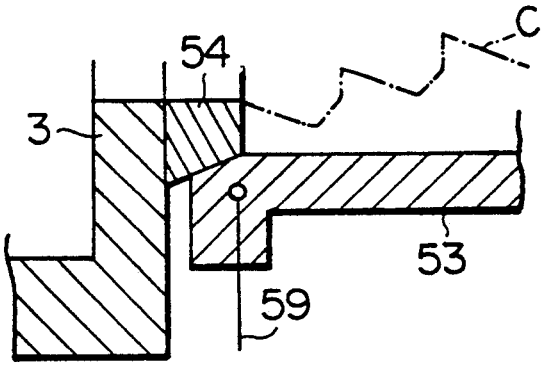
FIG. 32 is a longitudinal sectional view of the mold tube inlet portion for describing a normal withdrawal state.
Figure 34:
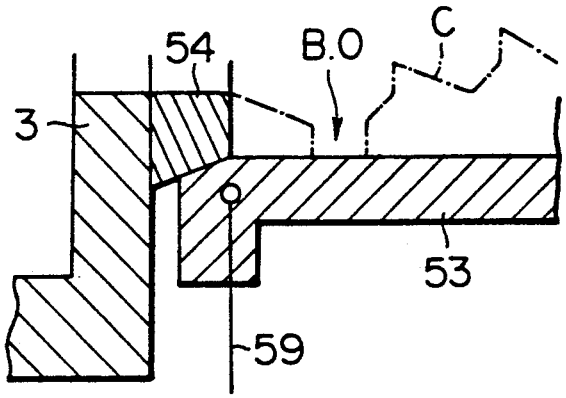
FIG. 34 is a partial sectional view of a mold tube inlet portion for describing the manner of generating a breakout.
Figure 35:
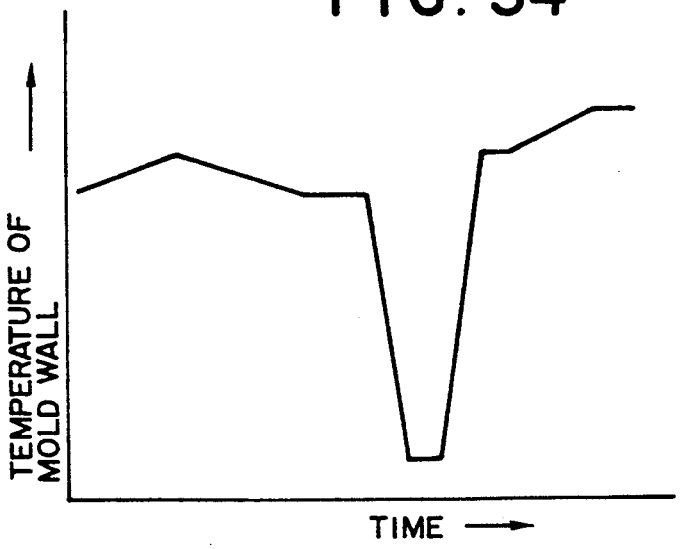
FIG. 35 is a graph showing detected mold wall temperature under a condition shown in FIG. 34.

The molten metal Y in the tundish 3 flows into the stationary mold tube 53, and when the second thermocouple 59 detects a temperature rise, the withdrawal of the strand W is started with the withdrawal of a dummy bar 64 in the stationary mold tube 53 as shown in FIG. 31, based on a preprogrammed withdrawal pattern. Because a projected guide member 64A is provided to deflect the molten metal flow toward the walls of the mold tube 53 as shown by arrows, thermal shrinkage of the metal at the time of initial solidification is compensated for and the dummy bar 64 is securely connected to the strand W. The second thermocouple 59 accurately supervises the solidification state at the time of initiating solidification. When the automatically started withdrawal pattern completes, the operation is automatically transferred to the normal withdrawal pattern described previously.

Where the withdrawal operation caused by the normal withdrawal pattern is being carried out normally as shown in FIG. 32, solidification starts behind the brake ring 54, so that the solidified shell C is continuously formed with a thickness sufficient to overcome the withdrawal resistance. As shown in FIG. 35, the mold wall temperature detected by the second thermostat 59 is substantially constant. However, where there is a problem such as sticking between the inner wall of the mold tube 53 and the shell C at the time of start of the solidification and imperfect fusing, the shell C will be broken to form breakout B.O as shown in FIG. 34. In such case, the temperature detected by the second thermocouple 59 will vary greatly as shown in FIG. 35. Due to this large temperature variation, the withdrawal control unit 63 operates for decreasing the withdrawing speed of the strand W. The degree of decrease of the withdrawing speed is set such that the solidified shell C will have a thickness sufficiently durable against the resistance to withdrawal, whereby breakage and leakage of the molten metal at the time of breakout can be prevented. With the withdrawal control described above, when the normal solidification state is resumed, the operation is automatically returned to the normal withdrawal pattern.

During the normal withdrawing operation, the temperature at the exit end of the stationary mold tube 53 is constantly monitored by the first thermocouple 58. Where the solidified shell is broken at the downstream side, with respect to the break ring 54, in the mold tube 53, the temperature detected by the first thermostat 58 increases rapidly. When the detected temperature increases above a predetermined value, the rotational speeds of the driving motors 24 and the pinch rollers 14 are controlled by the withdrawal control unit 63 comprising the calculator 61 and the control unit 62. Actually the withdrawing operation is stopped for a certain time or the withdrawal speed is decreased for cooling and solidifying the molten metal in the stationary mold tube 53, which has been partially flown out into the mold tube, thereby preventing leakage of the partially flown out molten metal to the outside of the mold tube 53 and restricting the melting of the stationary mold tube 53 itself.

When the temperature detected by the first thermostat 58 decreases below a predetermined value, that is, to the temperature during the normal withdrawing operation, the original withdrawal state is automatically resumed.

In the embodiment described above, the second and first thermocouples 59 and 58 are respectively provided behind the break ring 54 and at the outlet end of the mold tube 53, and the withdrawal operation is effected responsive to the temperatures detected by the two thermocouples for preventing leakage of the molten metal at the time of breakout. However, the control device may use only the second thermocouple 58. Furthermore, thermocouples may be provided for the respective exit ends of the adjustable molds 55, and the temperature signals detected by the plurality of thermocouples may be calculated as a whole for controlling the withdrawal of the strand for more accurate control.

In the embodiments described above, a normal open-type adjustable mold is used but it is possible to use a hermetically closed type adjustable mold in which a totally closed type casing, not shown, which hermetically enclose the mold as a whole is provided.

Figure 36:
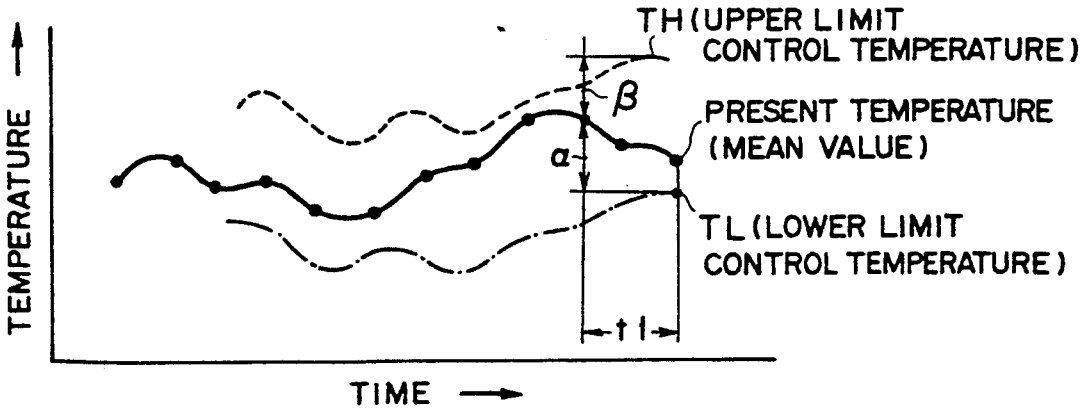
FIGS. 36 and 37 are graphs showing a method of setting control temperature for changing the withdrawal speed.
Figure 41:
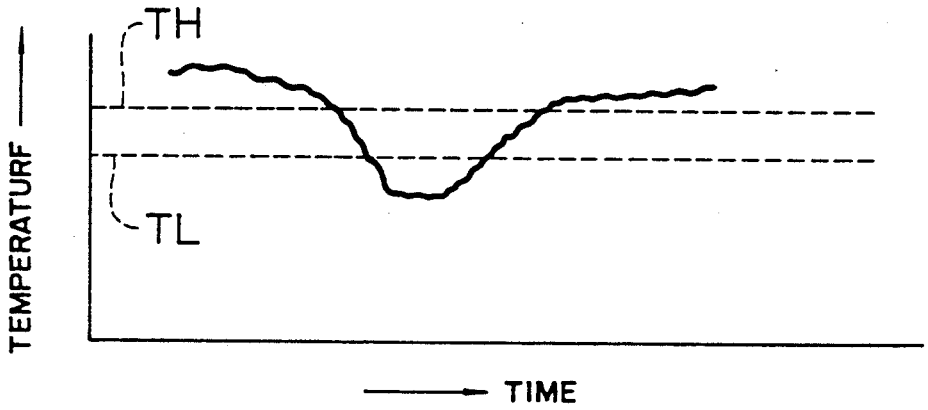
FIG. 41 is a graph showing variation with time of the temperature of prior art withdrawal control.

The content of calculation carried out by the calculator 61 in the withdrawal control unit 63 will be described below, wherein the control is made by using only the second thermocouple 58. First, a case will be described wherein a breakout occurs with a solidified shell existing near the downstream end of the break ring 54 at the time of intermittent withdrawal operation, and a setting of a first control temperature is necessary to change the withdrawing speed. As shown in FIG. 36, in each of the four thermocouples 59 provided at four sides of the cross-section of the strand, a mean value of temperatures detected at sampling intervals of 0.3 second, for example is calculated. Further, as shown in FIG. 36, a value obtained by subtracting a settable temperature $\alpha$° C. from the mean value of the temperature $t_1$ time before is set as a lower limit control temperature TL for increasing the withdrawal speed of respective sides of the mold tube 53. Further, as shown in FIG. 36, a value obtained by adding together a mean value of the temperature $t_1$ time before and a set temperature $\beta$° C. is set as an upper limit control temperature TH for decreasing the withdrawing speed at respective sides of the stationary mold tube 53. In contrast, in the prior art control device, control temperatures TL and TH are set as shown in FIG. 41.

Figure 37:
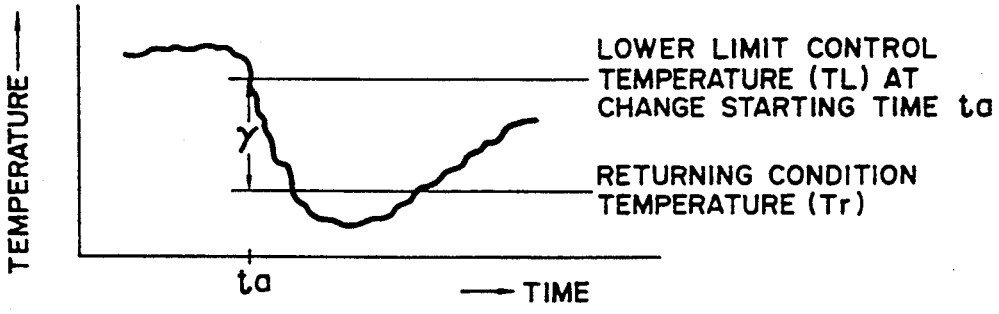
Figure 38:
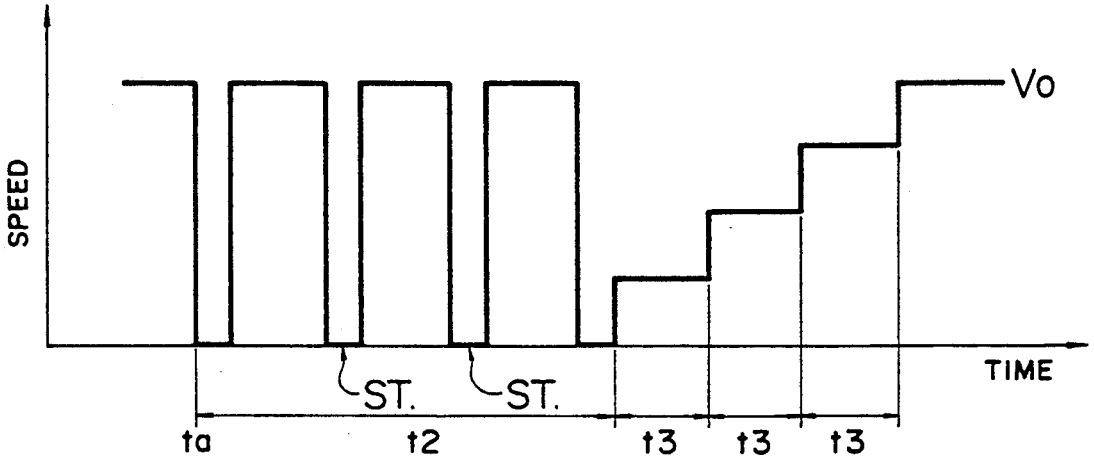
FIG. 38 is a graph showing a restoring operation of the withdrawal speed.

As shown in FIG. 37, a second control temperature necessary to restore the withdrawing speed to the original speed is set to a value obtained by subtracting a set temperature $\gamma$° C. from the temperature TL at the time of starting the change of the withdrawing speed. As shown in FIG. 38, restoration of the withdrawal speed is initiated when a set time $t_2$ has elapsed after the withdrawal speed changing starting point ta and when the present mean temperature has exceeded the second control temperature. The restoration of the withdrawing speed is performed stepwisely at intervals of a set time $t_3$. When the temperature rapidly increases beyond the control temperature TH, the withdrawing speed must be changed but the restoration of the withdrawing speed is made only by the operator. This is because where the detected temperature is high, fracture and wear, caused by mechanical factors, of the break ring 54 shown in FIG. 31 tend to occur so that it is desirable not to restore the withdrawing speed automatically.

The withdrawal control operation of this case will be described below.

First, the start of the withdrawal is initiated by the withdrawal of a dummy bar 64 according to a preprogrammed withdrawing pattern when the molten metal Y in the tundish 3 flows into the stationary mold tube 53 and the thermocouple 59 detects a temperature rise. When the above described automatically initiated withdrawing pattern is completed, the operation is automatically transferred to the normal withdrawing pattern.

Figure 33:
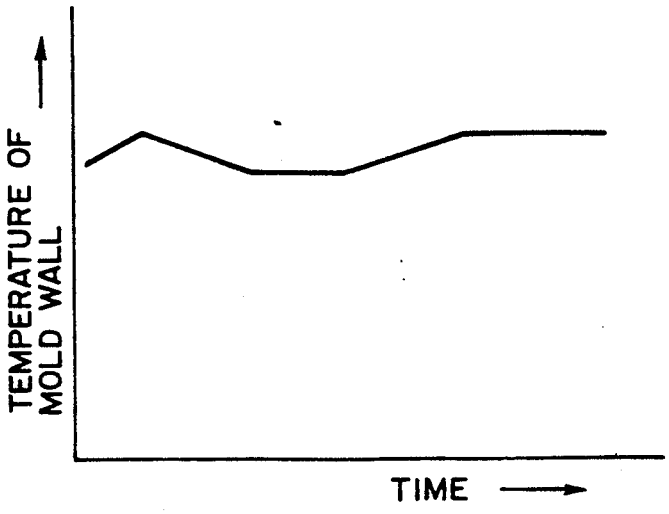
FIG. 33 is a graph showing mold wall temperature under the normal withdrawal state shown in FIG. 32.

When the withdrawal operation according to the normal withdrawing pattern is being carried out normally, the operation is identical to that described before. More particularly, as shown in FIG. 32, the solidification starts behind the break ring 54, and the solidified shell of the metal is continuously formed with a thickness sufficient to withstand the withdrawal resistance. At this time, the temperature detected by the thermocouple 59 is substantially constant as shown in FIG. 33. When the shell C is broken to generate a breakout B.O as shown in FIG. 34, due to the sticking of the shell C to the inner wall of the mold tube 53 or poor fusing together, the temperature detected by the thermocouple 59 varies greatly as shown in FIG. 35. Due to this large variation of the temperature, the withdrawal control unit 63 operates for automatically vary the withdrawing as will be described below.

Figure 39:
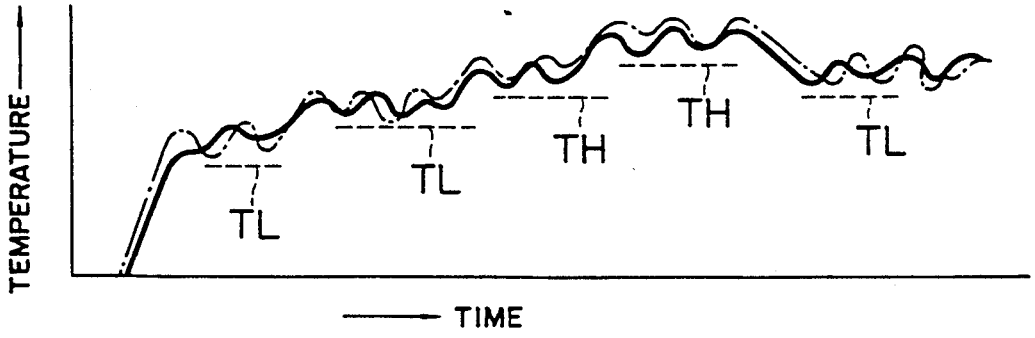
FIG. 39 is a graph showing variation with time of the temperature.

More particularly, the average value of the detected temperature is determined at respective sampling periods of the thermocouple 59. When the present temperature detected by the thermocouple 59 exceeds the control temperature TL or TH which is shown in FIG. 39 and set based on the mean value, the rotational speeds of the driving motors 24 and the pinch rolls 14 are controlled by the withdrawal control unit 63. More specifically, as shown at ST in FIG. 38, the withdrawal is once stopped or the withdrawing speed is decreased for cooling and solidifying the molten metal which has partially flown out in the stationary mold tube 53, thereby preventing the partially flown out molten metal from leaking to the outside of the stationary mold tube 53, with resultant prevention of damage of the mold tube.

Figure 40:
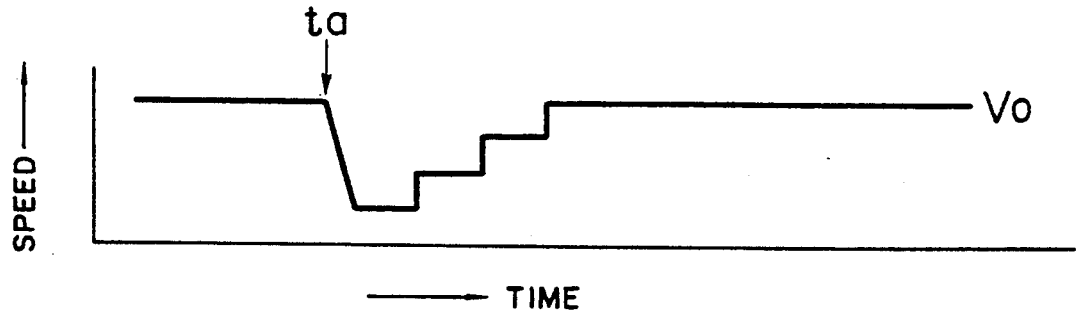
FIG. 40 is a graph showing variation with time of the speed at the time of restoring the withdrawal speed.
Figure 42:
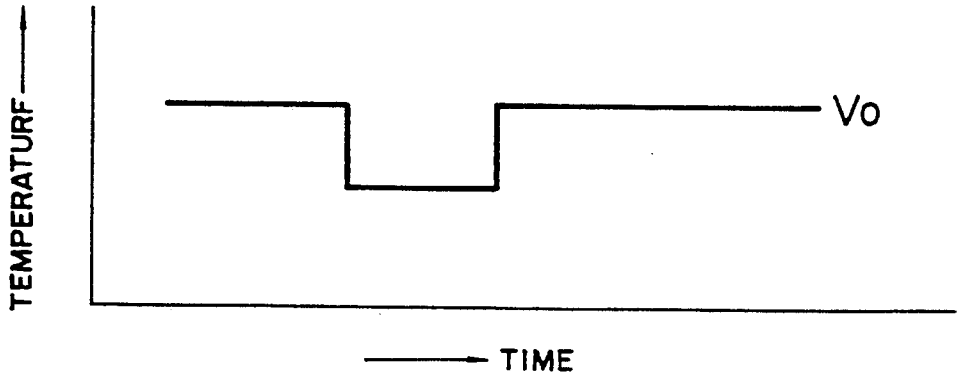
FIG. 42 is a graph showing variation with time of prior art withdrawal speed at the time of restoring.

As the withdrawal speed is varied, the temperature detected by the thermocouple 59 reaches the second control temperature described above. Then, as shown in FIG. 40, the withdrawing speed is increased gradually and stepwisely to resume the original withdrawing speed $V_0$, thereby preventing a strong force from being applied to the shell C. In contrast, in the prior art, the withdrawing speed is varied as shown in FIG. 42.

In the embodiment described above, four thermocouples 59 are used and the withdrawal control is made based on the detected temperatures. This is effective for the control of a strand W having a large crosssection such as a square strand. However, it is to be understood that only one thermocouple 59 may be used for the same control.

What is claimed is:

1. A method of withdrawing a strand in a horizontal continuous casting installation, wherein said strand is intermittently withdrawn by repeating a cycle of withdrawing the strand from within a mold connected to a tundish of the horizontal continuously casting installation, through a mold tube provided downstream of the mold, cover a predetermined stroke by means of strand withdrawing means, and retracting the withdrawn strand over a relatively short stroke, said method comprising the steps of:

presetting, in control means of said withdrawing means, one cycle of a strand withdrawing and retracting characteristic;

controlling said withdrawing means based on said strand withdrawing and retracting characteristic for each said cycle by said control means;

determining an instruction signal based on a comparison of a detection signal generated by detection means which detects an amount of withdrawal and retraction, with said strand withdrawing and retracting characteristic;

feedback controlling said withdrawing means in response to said instruction signal;

detecting a temperature at an exit end of said mold tube;

stopping temporarily withdrawing operation of said withdrawing means when said detected temperature exceeds a predetermined value;

causing said withdrawing operation of said withdrawing means to return to a control based on said strand withdrawing and retracting characteristic when said detected temperature returns to a normal value;

providing at least one temperature detecting means in a mold tube near a break ring provided between said tundish and said mold;

calculating a mean value of a periodic variation of the temperature detected by said temperature detecting means;

setting a first value obtained by subtracting a first set temperature from said mean value before a set time as a lower control temperature for changing said withdrawing speed;

setting a second value obtained by adding a second set temperature to said mean value before said set time as an upper control temperature for changing said withdrawing speed;

changing the withdrawing speed when a presently detected temperature detected by said temperature detecting means decreases below said lower control temperature or increases above said upper control temperature;

setting a value obtained by subtracting a third set temperature from said lower control temperature at a time of initiating changing of said withdrawing speed as a restoring temperature utilized for restoring said withdrawing speed;

restoring said withdrawing speed to the original speed when a presently detected temperature detected by said temperature detecting means exceeds said restoring temperature; and restoring said withdrawing speed by an operator when said presently detected temperature exceeds said upper control temperature.

2. The method according to claim 1, further comprising the step of detecting a temperature at an entrance end of said mold tube, and stopping temporarily withdrawing operation of said withdrawing means when the temperature detected at the entrance end exceeds a predetermined value.

3. The method according to claim 1, comprising the steps of detecting the rotational speed of said pinch roll; and determining said instruction signal by comparing said detected rotational speed with said strand withdrawing and retracting characteristic.

4. The method according to claim 1, comprising the step of automatically changing said strand withdrawing and retracting characteristic set in said control means by using a detection signal from detection means which detects an amount of movement of said strand near an exit end of said mold.

5. The method according to claim 4, comprising the steps of determining a mean value of deviations during a plurality of said cycles between a set retracting stroke included in said strand withdrawing and retracting characteristic and an actual retracting stroke obtained from said set retracting stroke and said detected signal; and changing the strand withdrawing and retracting characteristic by using said mean value such that said deviation will decrease.

6. The method according to claim 5, wherein said detection signal is a detection signal detecting the amount of movement of said strand near an outside of the exit end of said mold.

7. The method according to claim 4, comprising the steps of determining a mean value of deviations for a plurality of said cycles between a set withdrawing stroke characteristic contained in said strand withdrawing and retracting characteristic, and an actual withdrawing stroke obtained from said set withdrawing stroke and a detection signal; and changing said set withdrawing stroke characteristic by using said mean value such that said deviation will decrease.

8. The method according to claim 7, wherein said detection signal is a detection signal of the amount of movement of said strand near the outside of the exit end of said mold.

9. A method of withdrawing a strand in a horizontal continuous casting installation, wherein said strand is intermittently withdrawn by repeating a cycle of withdrawing the strand from within a mold connected to a tundish of the horizontal continuously casting installation, through a mold tube provided downstream of the mold, over a predetermined stroke by means of strand withdrawing means, and retracting the withdrawn strand over a relatively short stroke, said method comprising the steps of:

presetting, in control means of said withdrawing means, one cycle of a strand withdrawing and retracting characteristic;

controlling said withdrawing means based on said strand withdrawing and retracting characteristic for each said cycle by said control means;

determining an instruction signal based on a comparison of a detection signal generated by detection means which detects an amount of withdrawal and retraction, with said strand withdrawing and retracting characteristic;

feedback controlling said withdrawing means in response to said instruction signal;

detecting a temperature at an exit end of said mold tube;

decreasing the withdrawing speed of said withdrawing means when said detected temperature exceeds a predetermined value;

causing the withdrawing operation of said withdrawing means to return to a control according to said strand withdrawing and retracting characteristic of said withdrawing means when said detected temperature returns to a normal value;

providing at least one temperature detecting means in a mold tube near a break ring provided between said tundish and said mold;

calculating a mean value of a periodic variation of the temperature detected by said temperature detecting means;

setting a first value obtained by subtracting a first set temperature from said mean value before a set time as a lower control temperature for changing said withdrawing speed;

setting a second value obtained by adding a second set temperature to said mean value before said set time as an upper control temperature for changing said withdrawing speed;

changing the withdrawing speed when a presently detected temperature detected by said temperature detecting means decreases below said lower control temperature or increases above said upper control temperature;

setting a value obtained by subtracting a third set temperature from said lower control temperature at a time of initiating changing of said withdrawing speed as a restoring temperature utilized for restoring said withdrawing speed;

restoring said withdrawing speed to the original speed when a presently detected temperature detected by said temperature detecting means exceeds said restoring temperature; and restoring said withdrawing speed by an operator when said presently detected temperature exceeds said upper control temperature.

10. The method according to claim 9, further comprising the step of detecting a temperature at an entrance end of said mold tube, and decreasing the withdrawing speed of said withdrawing means when the temperature detected at the entrance end exceeds a predetermined value.

11. An apparatus for withdrawing a cast strand in a horizontal continuous casting installation, including withdrawing means having upper and lower pinch rolls which intermittently withdraw and retract a strand by repeating a cycle of withdrawing the strand over a predetermined stroke from a mold provided for a tundish of the horizontal continuous casting installation, and retracting said withdrawn strand over a small stroke, and servomotor means for driving the pinch rolls, said apparatus comprising:

control means preset with a strand withdrawing and retracting characteristic of one cycle;

detecting means for detecting strand withdrawing and retracting quantities for producing a detection signal;

means for comparing said detecting signal with said strand withdrawing and retracting characteristic for producing an instruction signal;

means for sending said instruction signal to said servomotor means, said servomotor means comprising servomotors provided for said pinch rolls, respectively, to drive the respective pinch rolls independently;

speed reduction means interposed between each servomotor and each pinch roll, said speed reduction means including a double lead type worm gear driven coaxially with each of said servomotors, a worm wheel meshing with said worm gear and secured coaxially to each of said pinch rolls, and means for finely adjusting an axial position of said worm wheel; and rotary driving means including a backlashless type coupling for connecting said servomotor to said worm gear.

12. The apparatus according to claim 11, wherein said detecting means comprises means for detecting a rotational angle of the pinch rolls of said withdrawing means.

13. The apparatus according to claim 12, wherein said detecting means includes means for detecting a rotational speed of said pinch rolls of said withdrawing means.

14. The apparatus according to claim 11, wherein said detecting means detects the strand withdrawing and retracting quantities adjacent an exit end of said mold, the apparatus further comprising:

calculating means for calculating a mean value of deviations between a set strand withdrawing stroke and a detected strand withdrawing stroke during a plurality of cycles by using a detection signal of said detection means, said calculating means further calculating a mean value of deviations between a set strand retracting stroke and a detected strand retracting stroke during the plurality of cycles by using the detection signal of said detecting means; and judging means for judging an abnormality when said mean values exceed respective set allowable values.

15. The apparatus according to claim 14, further comprising:

means for detecting a temperature at said exit end of said mold tube;

means for decreasing the withdrawing speed of said withdrawing means when said detected temperature exceeds a predetermined value; and means for causing the withdrawing operation of said withdrawing means to return to a control according to said strand withdrawing and retracting characteristic of said withdrawing means when said detected temperature returns to a normal value.

16. The apparatus according to claim 15, further comprising means for detecting a temperature at an entrance end of said mold tube, and means for decreasing the withdrawing speed of said withdrawing means when the temperature detected at the entrance end exceeds a predetermined value.

17. The apparatus according to claim 14, further comprising further detecting means for detecting a rotational angle of said pinch rolls; further calculating means for calculating a mean value of deviations between a set strand withdrawing stroke and a detected strand withdrawing stroke during a plurality of cycles by using a detection signal of said further detecting means and for calculating a mean value of deviations between a set strand retracting stroke and a detected strand retracting stroke during the plurality of cycles by using the detection signal of said further detecting means; and judging means for judging an abnormality when said mean values exceed set allowable values, respectively.

18. The apparatus according to claim 17, further comprising still further detecting means for detecting a rotational angle of said servomotor; still further calculating means for calculating a mean value of deviations between a set strand withdrawing stroke and a detected strand withdrawing stroke during a plurality of cycles by using a detection signal of said still further detecting means and for calculating a mean value of deviations between a set strand retracting stroke and a detected strand retracting stroke during the plurality of cycles by using the detection signal of said still further detecting means; and judging means for judging an abnormality when said means values exceed set allowable values, respectively.

* * * * *